US007765724B2

(12) United States Patent
Walker

(10) Patent No.: US 7,765,724 B2
(45) Date of Patent: Aug. 3, 2010

(54) APPARATUS AND METHODS FOR REFURBISHING ICE SURFACES

(75) Inventor: John A. Walker, Grand Junction, CO (US)

(73) Assignee: SCI (Stock Composite Incorporated), Grand Junction, CO (US)

( * ) Notice: Subject to any disclaimer, the term of this patent is extended or adjusted under 35 U.S.C. 154(b) by 199 days.

(21) Appl. No.: 11/770,949

(22) Filed: Jun. 29, 2007

(65) Prior Publication Data

US 2009/0000323 A1 Jan. 1, 2009

(51) Int. Cl.
*E01H 4/00* (2006.01)

(52) U.S. Cl. ..... 37/219

(58) Field of Classification Search ..... 37/196, 37/197, 219–225, 231, 232–241; 299/24–39
See application file for complete search history.

(56) References Cited

U.S. PATENT DOCUMENTS 2,763,939 A * 9/1956 Zamboni ..... 37/219
3,622,205 A 11/1971 Zamboni
3,636,725 A 1/1972 MacCracken
3,692,119 A 9/1972 Tucker
3,705,746 A * 12/1972 McLeod ..... 299/25
3,917,350 A * 11/1975 Bricher ..... 299/24
4,372,617 A 2/1983 Zamboni
4,586,275 A 5/1986 Henry et al.
5,938,991 A 8/1999 Pollock

FOREIGN PATENT DOCUMENTS

WO 2005064085 A1 7/2005

* cited by examiner

*Primary Examiner*—Robert E Pezzuto
(74) *Attorney, Agent, or Firm*—Dorr, Carson & Birney, P.C.

(57) ABSTRACT

An apparatus and method for resurfacing ice surfaces such as ice hockey playing surfaces wherein an ice shaving blade system and an ice scooping system operate over the entire width of (or the entire length of) the playing surface.

64 Claims, 18 Drawing Sheets

APPARATUS AND METHODS FOR REFURBISHING ICE SURFACES

BACKGROUND OF THE INVENTION

This invention is generally concerned with apparatus and methods for resurfacing those ice surfaces upon which certain ice sports and/or recreational activities take place e.g., ice hockey games, ice shows, public recreational skating, speed skating contests, ice curling, etc. The need to periodically refurbish/resurface/refinish such ice surfaces arises for various reasons. Not the least of these is the fact that many of these ice surfaces are routinely gouged and pitted by ice skate blades. The cutting action of ice skate blades also tends to create small piles of "snow" that sometimes interfere with certain high skill activities needed for some ice sports e.g., imparting straight travel paths to ice hockey puck shots.

Various machines have been developed over the years to carry out ice refurbishing operations. These machines usually take the form of truck-like vehicles that clean, smooth and resurface an ice rink's gouged and pitted ice surfaces. They were originally developed by Frank J. Zamboni in 1949. Indeed, such a machine is often colloquially referred to as a "Zamboni." The term Zamboni® is also a registered trademark. Be that as it may, Zamboni resurfacing operations generally start by scraping a top layer of ice from the ice surface being refurbished. Such a top layer of ice is removed to a desired depth (e.g., from about 1/64 to about 1/4 inch, with a 1/32 inch cut being very commonly used). The ice shavings created by such scraping operations are taken up by the Zamboni as the operation progresses. A layer of water is also coated on the resulting scraped ice surface just behind the Zamboni's advancing ice scraper blade. This water quickly freezes to form a new, smooth ice surface.

Next, it should be noted that Zambonis are self propelled vehicles that are often equipped with a sled component (also commonly referred to as a "conditioner") that performs the previously noted functions needed to effectively refurbish gouged and pitted ice surfaces. For example, the sled carries a large, very sharp blade (similar to those used in industrial paper cutters) that shaves a thin layer of ice from the top of the ice surface. An auger located in front of the blade sweeps the resulting ice shavings to the center of the sled where a second auger (or, in some earlier models, a paddle-and-chain conveyor) directs them to an ice shavings dump tank carried by the Zamboni.

A sprinkler pipe and towel system, positioned at the rear end of the sled, are used to lay down a film of clean water that serves to fill any residual grooves in the scraped ice and to form a new ice surface. Hot water (e.g., 140° F. to 160° F.) is frequently used because: (a) its use tends to better melt the blade roughened top surface of the ice and (b) hot water is less viscous than cold water, and therefore more readily spreads over the shaved ice surface. Such water is also often filtered and otherwise treated before it is heated in order to remove minerals and chemicals from locally supplied waters. This is done because such minerals and chemicals tend to detrimentally alter the composition of a new ice layer made from impure waters (e.g., making the resulting new ice relatively more brittle, or more soft, or sometimes even giving it pungent odors). The presence of such impurities also tends to make the resulting new ice layer undesirably "cloudy" or opaque in its visual appearance.

The other components of a Zamboni exist primarily to support those functions carried out by its sled component. For example, a Zamboni's engine (which usually runs on natural gas or propane) or electric motor provides its propulsion (e.g., by use of a four-wheel drive system that is typically used in conjunction with tires having carbide-tipped tire studs). These propulsion creating engines or motors also provide hydraulic power needed to perform other tasks such as raising and lowering the sled. A Zamboni's shaved ice transporting augers are also normally powered by such hydraulic power.

Many Zamboni-type ice resurfacers are also fitted with a board brush (a rotary brush powered by a hydraulic motor) that can be extended from, and retracted to, the left side of these machines by means of a hydraulically powered arm. This brush sweeps and helps gather accumulated bits of loose ice that often accumulate along a hockey rink's dasher boards. The use of such board brushes also generally serves to reduce the need for time-consuming rink edging operations. Nonetheless, the ice surfaces around the edges of ice rinks have a tendency to build up because a Zamboni blade does not normally fully extend beyond the sled's outer edge. This circumstance serves to prevent damage that might otherwise be caused by a Zamboni's moving contact with an ice rink's dasher boards. Consequently, a separate ice edger (a device similar to a rotary lawn mower), is often used to cut down the edges of the ice surface that the ice resurfacer blade does not reach. Ice edgers have not, however, always effectively dealt with the fact that the ice immediately contiguous to the sides of dasher boards tends to build up in ever enlarging bodies of ice having fillet-like cross-sectional configurations. These ice fillets are a special nuisance to the game of ice hockey because they can change the travel path of a hockey puck that is intentionally directed along the side boards of an ice hockey rink. Consequently, many modern Zambonis have tried to integrate edging operations into an overall ice-resurfacing operation. This is done by mounting a secondary, pneumatically controlled, guide and blade system on a side of these machines. Such devices have to date provided varying degrees of ice edging success.

Venerable as they are however, Zamboni-type ice resurfacing machines do have certain inherent limitations and/or drawbacks. Not the least of these follows from the fact that they are wheeled vehicles that are called upon to operate on a literal sheet of ice. Thus they are always confronted with gaining wheel traction on these icy surfaces. Again, to this end, Zambonis are normally provided with four wheel drive systems and studded snow tires. Nonetheless, certain problems inherently arise from the fact that a great deal of force is needed to scrape even a thin layer of ice (e.g., 1/32 inch) from the top of an ice surface over a typical 80 inch width of a Zamboni ice shaving blade. Moreover, those skilled in this art will appreciate that in order to cut to a uniform depth in an ice surface, a great deal of weight must be placed immediately over the Zamboni's ice shaving blade. However, as more and more weight is placed over the blade in order to help it achieve and maintain a desired uniform ice shaving depth, the Zamboni's tires will have a progressively more difficult time gaining traction on the ice surface. Indeed, these opposing, weight over blade vs. wheel traction considerations have, in effect, limited the width of the ice cut that can be made by a given Zamboni blade. For all practical purposes, these blades are limited to about 80 inches in width. This implies a need for over 12 trips (e.g., the 85 ft. width for a National Hockey League-sized rink÷a Zamboni's 80 inch blade width=12.75) up and down the as much as 200 foot length of such an ice hockey playing surface. Consequently, a typical Zamboni based ice hockey rink resurfacing job will take even a very skilled driver from about 10 to about 15 minutes to complete.

SUMMARY OF THE INVENTION

The apparatus and methods of this patent disclosure will generally serve to eliminate, or at least greatly reduce, the need for a Zamboni-type machine in order to refurbish an ice surface. This implies that the considerable costs associated with purchasing, operating, maintaining, insuring and storing machines of this kind can be eliminated or greatly reduced. Moreover, for reasons hereinafter more fully explained, the quality of the new ice surfaces created through use of Applicant's apparatus and methods will be inherently higher than those that can be achieved by Zamboni-type machines. Another added advantage associated with the practice of this invention is the fact that the time needed for a given ice resurfacing operation can be greatly reduced. For example, the ten to fifteen minutes needed for a Zamboni resurfacing of an ice hockey rink can be shortened to one to two minutes—or even less—through use of the present invention. Moreover, Applicant's shortened job time requirements—in conjunction with the higher quality ice surfaces that can be achieved—present an opportunity to print certain visual information (such as advertisements) on the newly resurfaced ice. Opportunities to place such printing under an ice surface also arise through application of this invention.

The advantages associated with the present invention are achieved through use of an ice shaving/scraping/planning (all of these terms meaning the same thing for purposes of this patent disclosure) blade system that extends substantially across an entire dimension of an ice rink surface to be refurbished. By way of explanation, Applicant's use of the expression "entire dimension" could be taken to mean the 85 feet width dimension of a National Hockey League-sized ice rink. However, in some alternative embodiments of this invention, the term "entire dimension" could also be taken to mean the 200 ft. length dimension of such an ice rink—rather than its 85 ft. width. For the purposes of specifically illustrating this invention, however, an ice shaving and resurfacing operation over the shorter dimension (e.g., over the 85 feet width of a regulation National Hockey League ice hockey playing surface—as opposed to its 200 foot length) will be used since such a width oriented shaving operation is the more practical mode of operation owing to the fact that it will require considerably less power to pull Applicant's ice shaving blade.

Home (Docking) Positions of Certain Apparatus Components

Next, Applicant would call attention to the fact that the apparatus and methods of this patent disclosure have several possible modes of operation. These modes of operation are associated with—and to some extent defined by—the "home position" or "docking position" of certain components of Applicant's apparatus. For example, one embodiment of this invention is associated with a situation wherein Applicant's ice blade system has a "home position" (the place where the ice blade system resides when it is not being used on the ice surface) that lies immediately beyond a first arcuate end zone of a subject ice rink surface. In this embodiment, Applicant's ice scoop system will have a home position (the place where the ice scoop resides when it is not being used on the ice surface) that lies immediately beyond an opposing, second arcuate end zone of the subject ice rink surface.

Another embodiment of this invention is associated with a situation wherein the ice blade system and the ice scoop system share a common home position when they are not being used to refurbish the ice surface. This second mode of operation can also be associated with the fact that the ice blade system and the ice scoop system are connected to each other and further connected to a docking bar system. This docking bar system will also have a home or docking position when it is not being used on the ice surface. Normally, the home or docking position for the docking bar system will be the opposing end of the ice rink from where the ice blade system and ice scoop system share their common home position.

Possible Modes of Operation

A first mode of ice refurbishing that can be carried out according to the teachings of this patent disclosure may begin by powering an ice scoop system from its home position (e.g., located just beyond the above noted opposing, second arcuate end zone of an ice rink surface), across the ice surface (e.g., across its 200 ft. length), to (or near) the home position of the ice blade system and then mechanically coupling, locking, attaching, etc. the ice scoop system to the ice blade system. The expression "to (or near)" is used to indicate that this "coupling, locking, attaching, etc." operation can take place anywhere in an end zone apparatus (hereinafter more fully described) or it can take place just outside of the ice blade system's "ultimate" home position (e.g., the coupling can be made when the ice blade system first comes to rest on the ice surface just after it leaves an end zone apparatus that may serve as the home position of the ice blade system). This coupling, locking, attaching, etc. could also take place in an alternative structure whose location and function will be discussed in subsequent parts of this patent disclosure.

It might be interjected here that this patent disclosure contemplates at least six ways of powering the ice scoop system over to the ice blade system. Moreover, these ways of powering the ice scoop system can also be employed to power other components of Applicant's apparatus that must be moved across the ice surface e.g., ice blade systems, docking bar systems, printer systems and water dispensing systems. These ways of powering any of these components include (but are not limited to) the following:

(1) rack and pinion systems wherein the rack is affixed to the floor of the boards and a pinion is attached to a component to be moved (e.g., the ice scoop system) and powered by a motor whose turning action moves the pinion (and hence the component) along the rack and wherein each of the components travels along the same rack;

(2) chain and sprocket systems having two spaced apart (e.g., 200 ft.) sprockets around which a chain is looped and wherein a moveable component of the apparatus (e.g., its ice blade system, scoop system, docking bar system, ice printer system, etc.) are provided with a clamping mechanism that grabs and locks on to one side of the chain loop and wherein the drive motor of the chain and sprocket system is rotated in one direction or the other to move any component that is clamped to the chain;

(3) an alternative chain and sprocket system wherein a span of chain (e.g., 200 ft. long) is affixed at both ends to the floor of the boards of an ice rink and wherein a motor powered sprocket is attached to a given moveable component (e.g., an ice blade system, an ice scoop system, a docking bar system, a printer system, etc.) so that as the sprocket is rotated in one direction or the other the moveable component is carried across the ice surface;

(4) cable drive systems having two spaced apart (e.g., 200 ft.) pulleys around which a cable is looped and wherein the moveable components are provided with a clamping mechanism that grabs and locks on to one side of the cable loop and wherein the drive motor of the cable drive system is rotated in one direction or the other to move any component that is clamped to the cable (in some embodiments of this invention each moveable component (blade, scoop, docking bar, printer) will be provided with its own pulley and cable system);

(5) an alternative system wherein a pulley and timing belt are employed in ways comparable to the ways in which the chain and sprocket system of paragraph (1) above or the cable drive system of paragraph (4) above function to move the various moveable components (e.g., the ice blade system, ice scoop system, the docking bar system, printer system, etc.); and (6) a timing belt based system wherein a span of timing belt (e.g., 200 ft.) is affixed at both ends to the floor of the ice rinks boards and wherein a motor powered timing pulley is attached to a given moveable component (e.g., an ice blade system, an ice scoop system, a docking bar system, a printer system, etc.) and rotated in one direction or the other to move the component across the ice surface and wherein all of components are powered along the same fixed timing belt.

Be all of these powering devices as they may, wherever it occurs, the coupling action of the ice blade system and the ice scoop system in Applicant's first mode of ice refurbishing creates a coupled ice blade/scoop system. This coupled ice blade/ice scoop system is then powered across the 200 ft. long ice surface toward the original home position of the ice scoop that is located immediately beyond the opposing, second arcuate end zone of the subject ice rink surface. The ice shaving function of this first mode of operation occurs during this trip of the coupled ice blade/scoop system in its ice shaving direction, i.e., toward the home position of the ice scoop. During this ice shaving operation, water is also dispensed onto the ice surface from a water dispenser located, for example, behind the ice blade system. In still other embodiments of this invention, the water dispensing system could be associated with the ice scoop system or with a docking bar system. This water may be purified and/or heated for the reasons previously noted with respect to Zamboni operations.

The power needed to pull the coupled ice blade/scoop system during the ice shaving operation can be, by way of example only, supplied by a tension creating device (e.g., a chain system, a cable system, a belt system) whose one end is attached to the ice scoop and whose other end is attached to a power source (such as a motor, engine, hydraulic device, pneumatic device and the like) that pulls from the direction of the second arcuate end zone side of the ice rink. In the alternative, the coupled ice blade/scoop system can be powered during this ice shaving operation by rack and pinion systems and/or by various dynamic, powered devices or static chain devices of the types previously noted. Again, in order to employ such dynamic powered devices or static chain devices the ice blade system and/or the ice scoop system will be provided with clamping/unclamping devices capable of engaging with/disengaging from such dynamic powered devices or static chain devices (see for example FIG. 9) Various powered wheel systems hereinafter more fully described could also be employed to power the ice blade system and/or ice scoop system—especially during their ice shaving operations. Many of these powering systems may reside in (or next to) the side boards of the ice rink.

In any case, when the ice blade/scoop system arrives at a position at (or near) the home position of the ice scoop, the ice shavings are disposed of e.g., by dumping, heating, augering, paddling, etc. The ice shaving operation is now completed. Here again, the parenthetical expression "at (or near)" in the previous sentence is used to indicate that ice shavings disposal etc. can take place just outside the home position e.g., on the right end of the ice surface just before the ice scoop system enters an end zone apparatus that serves as the ultimate home position of the ice scoop system—or the uncoupling can take place anywhere in the end zone apparatus. The ice shavings disposal can also occur in an alternative structure located beyond the end of the ice rink. As will be seen in FIG. 1 of this patent disclosure, such an alternative structure could be located beyond (e.g., 1 ft. to 100 ft.) the first arcuate end zone of the ice surface and have a bottom level that is at an elevation such that an ice blade system that rests upon said bottom level is substantially at an elevation comparable to an elevation of the ice surface. Use of this alternative structure will also involve the use of an alternative method of lifting an arcuate end board portion. For example, the left arcuate end board portion shown in FIG. 3 could be lifted by an array of cables that are pulled upward by one or more lifting cranes located in the roof superstructure of the ice sports facility. In either case, and in whatever home position the ice scoop may occupy, the ice blade system is mechanically uncoupled, unlocked, disassociated, etc. from said ice scoop system and powered back to its home position at the opposing end of the rink.

The power for this return trip of the ice blade system to its home position can be supplied by any of the various dynamic, powered devices, static chain devices and/or rack and pinion devices previously noted, and preferably residing in the side boards of the ice rink. And, as was previously mentioned, the ice blade may be provided with a gripping device to engage with a chain system, cable system, belt system that powers said ice blade system to its home position. The return of the ice blade system to its home position completes this first mode of operation of the ice refurbishing apparatus of this patent disclosure. The powering device that brought the ice blade to its home position is then shut off. It might also be noted here that the return trip of the ice blade presents a good opportunity to use a printer that is capable of printing on the ice surface and which is attached to said ice blade system.

A second mode of ice refurbishing that can be carried out according to the teachings of this patent disclosure can begin by powering a docking bar system from its home position (e.g., just beyond the previously noted opposing, second arcuate end zone of the subject ice rink surface), dragging the docking bar's tensioning chains, cables, etc. with it, across the ice surface (e.g., across its 200 ft. length) to (or near) the home position of a coupled ice blade/scoop system and then mechanically coupling, locking, attaching, etc. the docking bar system to the coupled ice blade/scoop system. This creates a coupled ice blade/scoop/docking bar system. The powering device that brought the docking bar system to this position is then shut off. Thereafter, the coupled ice blade/scoop/docking bar system is powered (by the tensioning chains, cables, etc. attached to the docking bar) in an ice shaving operation across the ice surface toward the original home position of the docking bar system located immediately beyond the opposing, second arcuate end zone of the subject ice rink surface. In an alternative, the docking bar system could be brought to a home position in an alternative structure located immediately beyond (e.g., 1-100 ft.) the second arcuate end zone of the ice surface and whose bottom level is at an elevation such that a docking bar system that rests upon said bottom level is substantially at an elevation comparable to an elevation of the ice surface. Use of this alternative structure also will involve the use of an alternative method of lifting the right arcuate end board portion. As was the case with lifting the left arcuate end board portion, in order to employ an alternative structure, the right end board portion could also be lifted by an array of cables (comparable to cables 17A, 17B and 17C) powered upward by a crane system in the roof superstructure of the sports facility.

In any case, the ice shaving operation of Applicant's second mode of operation occurs during this trip of the coupled ice blade/scoop/docking bar system in its ice shaving direction, i.e., toward the home position of the docking bar system. The new ice forming water (that may well be purified and/or heated) is also dispensed during this ice shaving operation. Here again, the power needed to pull the coupled ice blade/scoop/docking bar system during this ice shaving operation can be supplied by a tension creating device (e.g., a chain system, a cable system, a belt system, etc.) whose first end is attached to the docking bar system and whose second end is attached to a power source such as a motor, engine, hydraulic device, pneumatic device and the like. In the alternative the coupled ice blade/scoop/docking bar system can be powered during this ice shaving operation by a rack and pinion system and/or by various dynamic, powered devices, or static chain devices heretofore noted that may reside in the side boards of the ice rink. And here again, use of such dynamic, powered devices, or static chain devices will require that the ice blade system, the ice scoop system and/or the docking bar system be provided with clamping/unclamping devices that can engage with and disengage from the dynamic, powered devices or static chain devices (see for example those devices depicted in FIG. 10).

Be all of that as it may, when the ice blade/scoop/docking bar system arrives at (or near) the home position of the docking bar, the ice shavings are disposed of e.g., by dumping, conveying, heating, augering, paddling them. This ice shaving operation is now completed. The power delivering device that brought the ice blade/scoop/docking bar system to this home position of the docking bar system is then shut off. Thereafter, the coupled ice blade/scoop system is mechanically uncoupled, unlocked, disassociated, etc. from the docking bar system. The coupled ice blade/scoop system is then powered back to its home position at the opposing end of the rink. This represents another opportunity for a printer associated with the ice blade/scoop system to print on the newly created ice. The power for this return trip of the coupled ice blade/scoop system to its home position can be supplied by the dynamic, power delivering devices, by certain static chain devices and/or by certain rack and pinion devices previously noted that will preferably reside in the side boards of the ice rink. The return of the ice blade/scoop system to its home position completes the second mode of operation of the ice refurbishing apparatus of this patent disclosure. The power delivering device that brought the ice blade/scoop system to its home position is then shut off.

In another mode of operation of Applicant's ice refurbishing apparatus, an ice blade system will leave its home position (e.g., located, for example, in a first end zone apparatus located just beyond the above noted first, arcuate end zone of an ice rink) and be powered in an ice shaving direction by a rack and pinion system (or by a dynamic chain, cable, belt system) located in the boards in ways illustrated in FIG. 10. The pinion component of the rack and pinion system will be a powered pinion that is mounted to the ice blade system itself. Thereafter, an ice scoop system will leave its home position, that is also located in the first end zone apparatus, (or in a left end zone alternative structure), and be independently powered (not be associated with the ice blade system) across the ice behind the advancing ice blade system. In other words, the independently powered ice scoop system will follow (but not be powered by) the ice blade system and "scoop up" (using scoop edges, brushes, augers, etc. associated with the ice scoop system) the ice shavings created by the ice blade system. The independent powering of the ice scoop system also could be by operation of a rack and pinion system wherein the scoop is equipped with a powered pinion that travels over the same rack employed by the ice blade system.

Upon reaching the opposing end of the rink, the ice shavings collected in the ice scoop system are disposed of (e.g., by dumping, heating, augering, paddling, etc.). Thereafter, the ice scoop is pulled back across the ice surface to its home position beyond the left end of the ice surface. The ice blade system can follow the ice scoop back to its home position (also located beyond the left arcuate end zone). In the alternative, the ice scoop system—still filled with ice shavings—can be powered back to the left end zone where the ice shavings are disposed of. This implies that much of, or even all of, the apparatus and equipment located in the right end zone apparatus, right end zone trench and/or right end structure can be eliminated.

Other modes of operation are made possible through use of an ice shaving system having two or more blades. For example, a first ice shaving blade could face in a first ice shaving direction and a second ice shaving blade could face in the opposite direction. Thus, for example, the first ice shaving blade could make a "rough" ice cut (e.g., to a depth of 1/32 inch) in a first ice shaving direction (from left to right) and the second ice shaving blade would make a "fine" ice cut (e.g., to a depth of 1/64 inch) while moving in a second (opposing) ice shaving direction.

This patent disclosure also contemplates the use of a single end zone raising system and a mode of operation wherein a curved blade and an associated ice scoop move from their common home position down the length of the ice surface to the opposite end zone. There the curved blade is lowered to shave the ice in the shape of the arcuate end zone and then shave the remainder of the ice surface on its way back to its home position. In this embodiment, the water for a new ice layer is preferably dispensed from the curved ice blade system.

In still other ice refurbishing modes of operation of the apparatus of this invention, the ice shaving blade, the ice scoop and/or the docking bar can be powered by independent power sources for their return trips to their respective home positions. By way of example only, an ice blade/scoop system could be powered by a first dynamic power system (e.g., dynamic chain, cable or belt systems located in the rink's side boards) while the docking bar system is returned to its home position by a second power system (e.g., by a tension creating system such as a chain system, cable system and the like); or the docking bar system could be powered to its home position by a powered rack and pinion system whose rack component is mounted in an ice rink's dasher boards. The docking bar system could also be powered to its home position by a dynamic, powered device, or by a static chain device that could respectively reside in the rink's dasher boards.

This return trip of the docking bar system represents another good opportunity for a printer, that is attached to the docking bar system, to print on the newly created ice surface. That is to say that, since Applicant's apparatus and methods for refurbishing an ice rink will require relatively short periods of time (e.g., one to two minutes) and since the new ice surfaces produced by them will be especially even and smooth over their entire width, the opportunity presents itself to print of such new ice surfaces once they are formed. Again, since printing devices (e.g., such printing devices may use printer fluids e.g., inks, dyes, etc. or powdered printing compositions to actually write on the ice surface) can be attached to any of Applicant's components that travel over the ice surface (i.e., the ice blade system, the ice scoop system and, especially, the docking bar system) there will be several opportunities to print with a print head that could be as much as 85 ft. wide. In another alternative, a separate and distinct printer device (e.g., about 85 ft. wide) can be employed to print on the newly refurbished ice. For example, such a printing device can have its own clamps for engaging with the dynamic powering devices that otherwise power the ice blade system, the ice scoop system and the docking bar system to their respective home positions.

The above noted ability of the apparatus and methods of this patent disclosure to quickly create new ice surfaces also creates opportunities to place written information under the top surface of newly formed ice—rather than upon the top surface of such ice. By way of example only, the ice surface may be shaved to some desired relatively deep depth (e.g., from about ¼ to ½ inch) by a series of ice shaving passes using relatively shallow ice shaving depths (e.g., from about 1/32 to about ¼ inch). When the desired depth is attained, an image (or other information) is then printed upon the ice surface at the desired depth. Thereafter, a first water dispensing pass is made over the ice surface having the printed image, information, etc. The layer of water laid down in this water dispensing pass will quickly freeze (e.g., in about 30 seconds) into a first layer of print-covering ice. After that, a second water dispensing pass will be made over the first layer of print covering ice to create a second layer of print covering ice. This second layer will likewise very quickly freeze. This process can be repeated over and over again until the cumulative layer of print covering ice has attained some desired thickness (e.g., from ¼ to ½ inch) and thereby protecting the printed image, information, etc. from ice skate gouges in the ice surface.

DETAILED DESCRIPTION OF THE INVENTION

Figure 1:
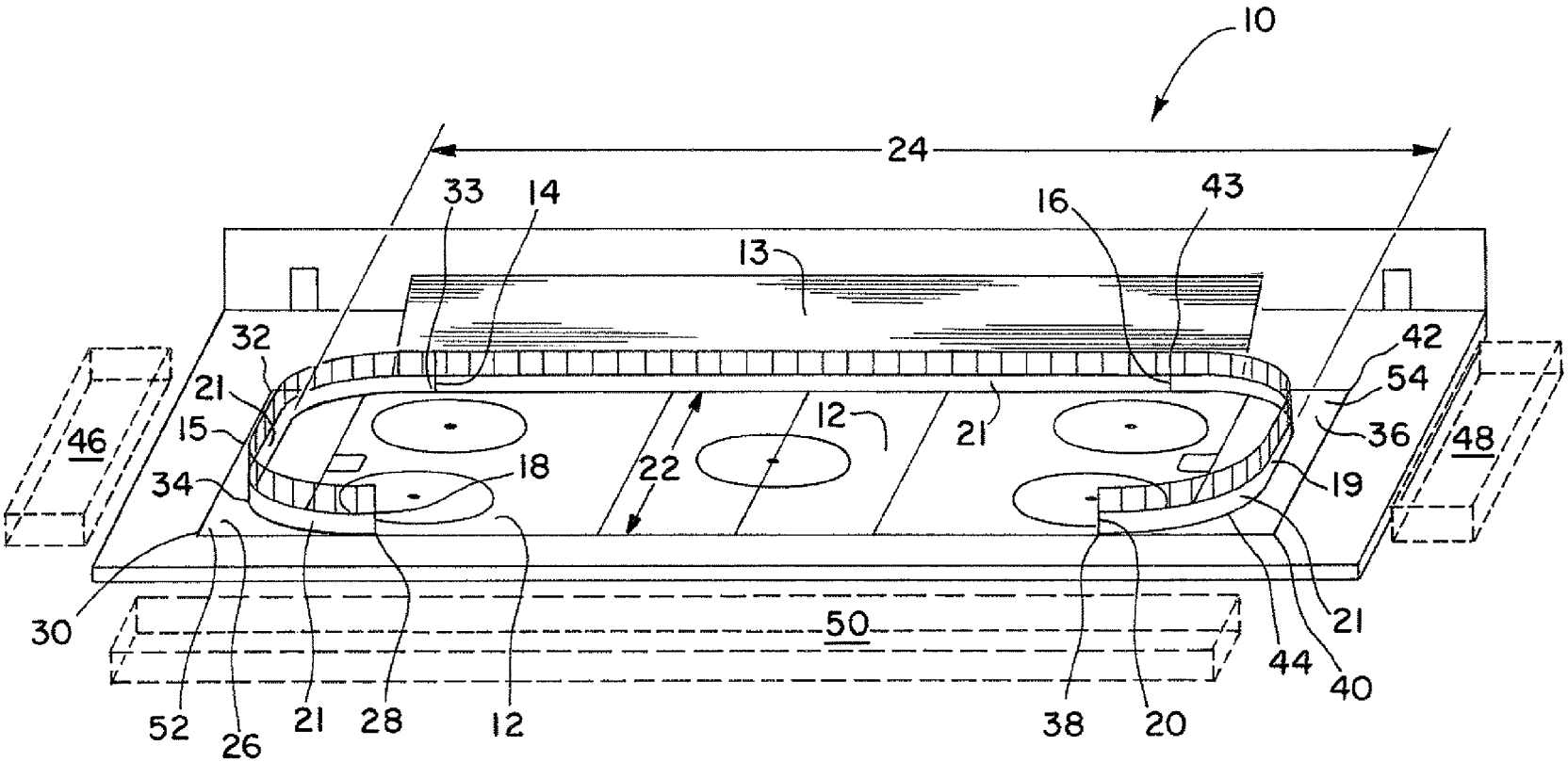
FIG. 1 is a perspective view of a portion of an ice sport facility (i.e., an ice hockey rink) shown provided with certain apparatus used to carry out the present invention.

FIG. 1 is a perspective view of an ice sport facility 10 having an ice surface 12 and spectator seating 13. The ice surface 12 is depicted as having a configuration and markings appropriate to the game of ice hockey. For example, its center region is rectangular in configuration and each end of the rectangular center region is respectively contiguous to an arcuate end zone region. Most of the perimeter of this ice hockey playing surface is shown surrounded by a dasher board system that normally has a height of approximately 40 inches (about 1 meter). Such dasher board systems are often referred to colloquially as "the boards." The parallel, linear portions (e.g., 14-16 and 18-20) of such ice hockey rinks are often referred to as "the side boards." Similarly, the arcuate end zone portions of such a dasher board system are sometimes referred to as the "end zone boards." The arcuate, left end zone dasher board portion of the boards shown in FIG. 1 is designated by item numbers 14, 15 and 18. The arcuate, right end zone dasher board portion of the boards is designated by item numbers 16, 19 and 20. The board system in general has been designated by item number 21. Another comment with respect to FIG. 1 might be that the linear side board portion 14-16 of the ice hockey rink is shown in full while the opposing, parallel, linear side board portion 18-20 has been removed for purposes of better illustrating certain aspects of this invention. Under normal conditions a linear side board portion 18-20 would be present and substantially identical to the linear side board portion 14-16 that is shown.

It might again be noted here that most North American hockey rinks are built to National Hockey League specifications. They call for a width 22 of 85 ft. (at the rink's widest dimension) and a length 24 of 200 ft. (at its longest dimension). Such hockey rinks are also provided with a corner radius of 28 ft. Ice hockey rinks in the rest of the world usually follow International Ice Hockey Federation specifications. They call for 61 meter lengths×30 meter widths in conjunction with a corner radius of 8.5 meters. Thus, if the ice surface 12 in FIG. 1 were built to National Hockey League specifications, the width dimension 22 of the ice hockey playing surface 12 depicted in FIG. 1 (at its widest part) would be 85 ft. If constructed to International Ice Hockey Federation specifications the width dimension of that playing surface would be 30 meters (about 98.5 ft.).

It should be specifically understood, however, that the ice hockey rink depiction of FIG. 1 is offered by way of example only. That is to say that the apparatus and methods of this invention can be employed with respect to a wide variety of other ice surfaces such as those employed for ice shows, rinks for recreational ice skating by the public, speed skating courses, ice curling facilities and the like. Thus, the wide ranging applicability of this invention remains valid even if the ice surface is not surrounded by a vertical perimeter such as "the boards." For example, this is the case in ice speed skating facilities and ice curling arenas.

Be that as it may, the ice sport facility 10 of FIG. 1 is somewhat different from those heretofore encountered in the world of ice hockey. For example, FIG. 1 shows the left end zone dasher board portion (14, 15, 18) of the boards 21 associated with a left top plate 26 having three sides 28-30, 30-32 and 32-33 that are rectangular in configuration. A fourth side 34 of the left top plate 26 is however arcuate in its configuration. This left top plate 26 is shown associated with the arcuate left end zone dasher board portion (14, 15, 18) in the sense that the size and curvature of the arcuate fourth side 34 of the left top plate 26 generally corresponds in size and curvature to the left end zone dasher board portion (14, 15, 18) of the boards 21. This left top plate 26 is also the top surface of a left end zone apparatus (not otherwise shown in FIG. 1) whose structure and function will be hereinafter more fully explained. The opposing arcuate right end zone dasher board portion (16, 19, 20) is shown associated with a right top plate 36 that is generally comparable in size and configuration to the left top plate 26. That is to say that it too has three rectangular sides 38-40, 40-42, 42-43 and an arcuate side 44. This right top plate 36 is also a top surface of a right end zone apparatus (not otherwise shown in FIG. 1) whose structure and functions will likewise be hereinafter more fully described.

FIG. 1 also suggests the possible presence of certain other structures not normally found in present day ice hockey facilities. For example, a first rectangular structure 46 is shown generally located immediately (e.g., 1-100 ft.) beyond the left arcuate end zone of the ice surface 12. This structure 46 will generally have a bottom at an elevation such that an ice blade system that rests upon said bottom level is substantially at an elevation comparable to an elevation of the ice surface. The function of this structure 46 is to house an ice shaving blade hereinafter more fully described (and certain mechanical equipment associated with that blade). This structure 46 could even be hidden from public view by virtue of being located substantially under spectator seating (not shown in FIG. 1) on the left end of the sports facility 10. This structure 46 is shown in phantom lines because its presence should be regarded as optional and/or an alternative for the purposes of this patent disclosure—for various reasons hereinafter much more fully discussed. A comparable, second rectangular structure 48 is shown positioned to the right of the right arcuate end zone dasher board portion (18, 19, 20). Its function is to house an ice scoop system (and certain mechanical equipment). This structure 48 will generally have a bottom level at an elevation such that an ice scoop system that rests upon said bottom level is substantially at an elevation comparable to an elevation of the ice surface. Structure 48 is also shown in phantom lines because its presence is likewise optional or alternative in nature to this patent disclosure. It also could be substantially located under spectator seating (not shown) on the right side of the sports facility 10. A relatively larger third structure 50 is shown positioned away from, and parallel to, a linear side board portion (18, 20) of the boards 21 not otherwise shown in FIG. 1. It too could reside under spectator seating not shown in FIG. 1. Here again, its presence is depicted in phantom lines because its use is in the nature of an alternative embodiment of this invention as well. A counterpart structure to structure 50 could also be located under the spectator seating generally indicated by item 13. It is not shown for reasons of visual clarity. Again, the virtues associated with the presence oft and locations of, these alternative structures 46, 48 and 50 will follow.

FIG. 1 also illustrates an embodiment of this invention wherein the subject ice resurfacing apparatus is in a first vertical operating position. In this first vertical operating position, a left end zone apparatus 52 (whose top surface 26 only is visible in FIG. 1) and a right end zone apparatus 54 (whose top surface 36 only is visible in FIG. 1) are both in their respective "down" positions. Next, it should be noted that the arcuate left end dasher board portion (14, 15, 18) is mounted on top of the left top plate 26. By way of example, the ice shaving blade system of this patent disclosure (not shown) can have its "home position" in this left end zone apparatus 52. Similarly, the arcuate right dasher board portion (16, 19, 20) is mounted on top of the right top plate 36 of the right end zone apparatus 54. An ice scoop system of this patent disclosure (not shown) can have its "home position" in this right end zone apparatus 54.

Figure 2:
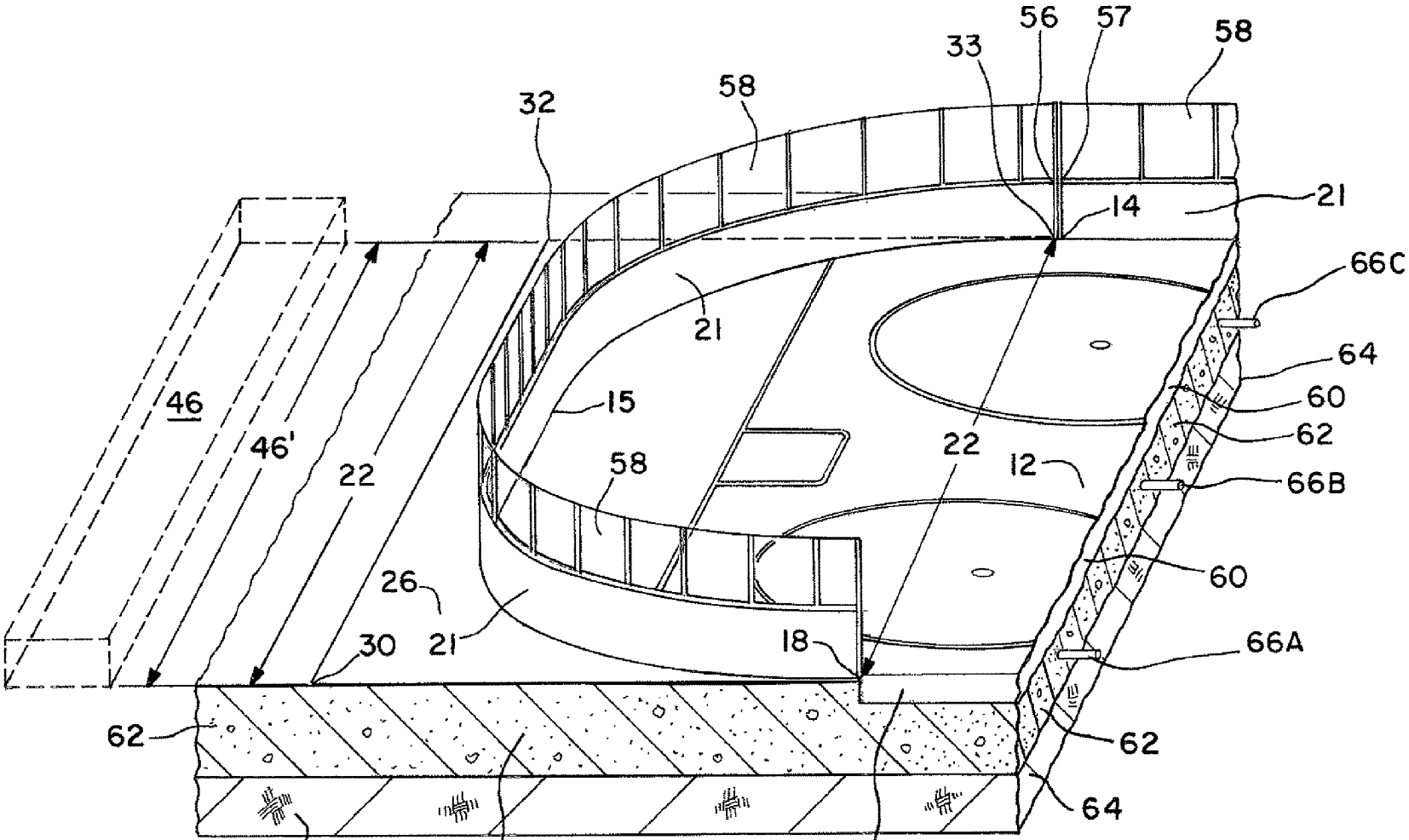
FIG. 2 is an enlarged view of the left arcuate end zone of the ice hockey rink of FIG. 1 showing a left arcuate end zone apparatus in its first (lowered) vertical operating position.

FIG. 2 is an enlarged view of the left end of the ice hockey rink shown in FIG. 1. It particularly illustrates that: (1) the width 22 of the ice surface 12 at its widest part, (2) the width (30-32) of the left top plate 26 and (3) the length 46' of the phantom structure 46 are all of comparable size. This circumstance follows from the fact that these dimensions all relate to the length of an ice shaving blade system (not shown in FIG. 2). In this embodiment, the length of the ice shaving blade system is substantially the same as the width 22 of this hockey rink at its widest part (i.e., 85 feet in the case of a NHL-sized ice rink). Next, it might be noted that in the "down" position shown in FIG. 2, the arcuate end zone boards will have an elevation 56 that is substantially the same as the elevation 57 of the linear side boards 14-16. FIG. 2 also incidentally illustrates that, for safety reasons, the perimeter of ice hockey rinks are often surrounded by a safety glass 58 (e.g., Plexiglas) system that is mounted on top of the boards 21 in order to prevent hockey pucks from inadvertently leaving the ice hockey playing area and going into the sports facility's spectator seating areas. FIG. 2 also incidentally suggests how such an ice surface 12 is generally constructed. For example, it shows how an ice slab 60 is built upon a concrete slab 62 that, in turn, is built upon a ground layer 64. The concrete slab 62 is also shown provided with a chiller pipe system 66A, 66B, 66C, etc. that serves to freeze the ice slab 60. The refrigeration equipment needed for this task is not shown.

Figure 3:
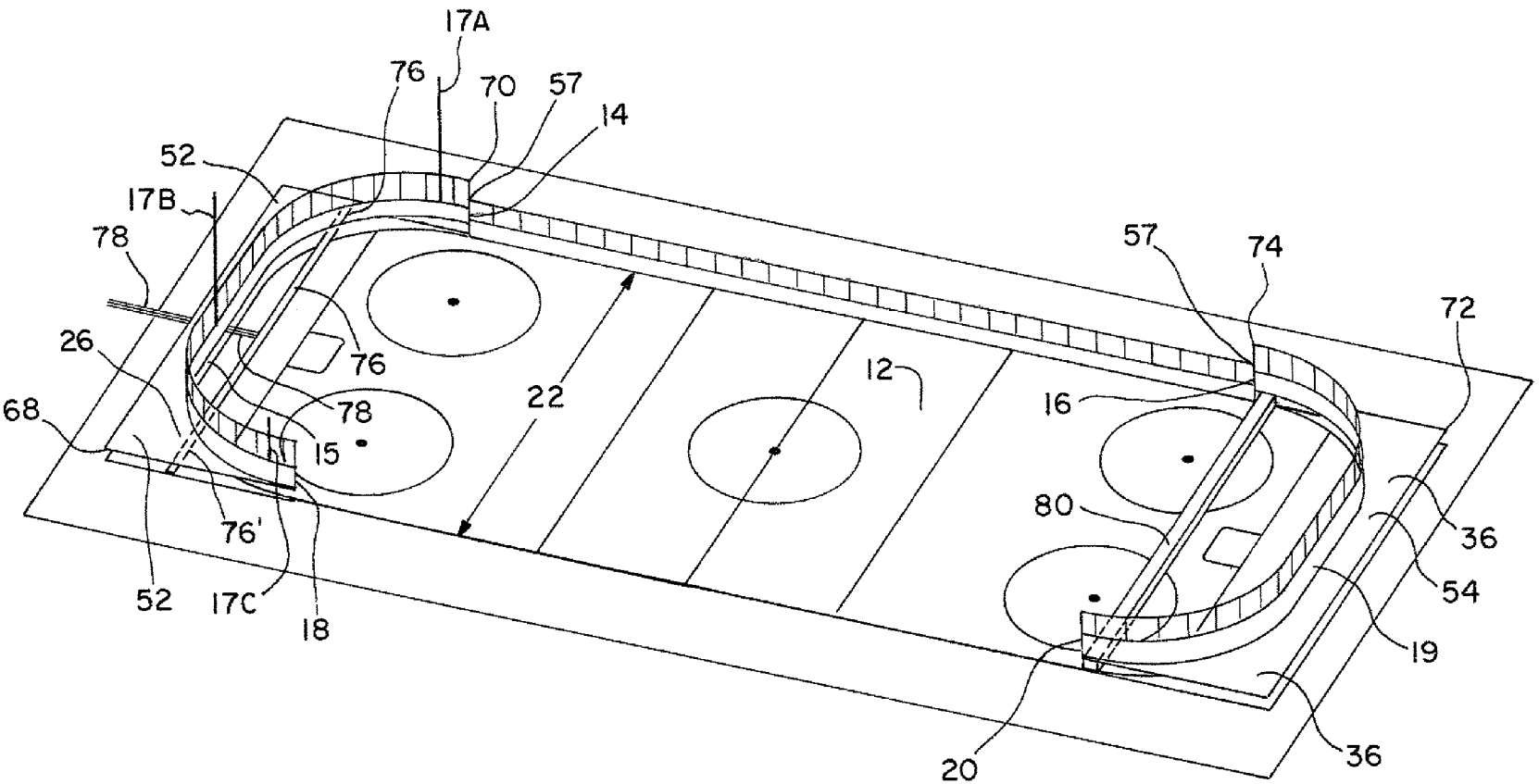
FIG. 3 is another perspective view of the ice hockey rink of FIG. 1, but wherein the left arcuate end zone apparatus and a right arcuate end zone apparatus are in their second (raised) vertical operating position.

FIG. 3 illustrates a second vertical operating position of Applicant's ice resurfacing apparatus. It is in its "up" position wherein both the arcuate left end zone dasher board portion (14, 15, 18) and the arcuate right end zone dasher board portion (16, 19, 20) of the boards 21 are raised vertically relative to their down positions depicted in FIGS. 1 and 2. In this up position the vertical height 68 of the top plate 26 of the left end zone apparatus 52 is above (e.g., about 8 to 12 inches above) the top level of the ice surface 12. Consequently, the vertical height 70 of the safety glass portion of the arcuate left end zone dasher board portion (14, 15, 18) is now above the height 57 of the adjoining linear portion (14, 16) of the safety glass of the side boards. A comparable situation exists on the right end of the rink. That is to say that the vertical height 72 of the top plate 36 of the right end zone apparatus 54 is above the top surface of the ice. Consequently the vertical height 74 of the safety glass of the arcuate right end zone dasher portion (16, 19, 20) is shown positioned above the height of 57 of the safety glass of the contiguous linear portion 14-16 of the side boards.

The second vertical position of the left end zone apparatus 52 (again, its "up" position) allows an ice shaving blade system 76, that can be housed in the left end zone apparatus 52 (the blade's "home position"), to be brought to a vertical height that is substantially the same as the vertical height of the top surface of the ice surface 12. The ice shaving depth of the ice shaving blade system 76 can then be adjusted to a desired ice shaving depth. This ice shaving blade system 76 is also shown provided with a flexible inlet system 78 for delivering various utilities (water, air pressure, electricity and, in some cases hereinafter more explained, even a printing fluid, ink, dye, etc. or a powdered coloring agent for printing on the ice surface). These utilities could also be delivered to an end (e.g., 76') or to both ends of the blade system 76 as well. Next it should be noted that the ice shaving blade system 76 can be powered to its raised or "up" position using any one of several possible lifting devices (not shown in FIG. 3). This second (or "up") vertical operating position of Applicant's ice refurbishing apparatus also allows an ice scoop system 80 that was housed in the right end zone apparatus 54 (the scoop's "home position") to be brought to a vertical height that is also just slightly above the vertical height of the top surface of the ice surface 12. The ice scoop system 80 can likewise be powered to this position using various powering devices (not shown in FIG. 3). It might also be noted here that other portions of the boards, e.g., portion 14-16 and/or 18-20 could be lifted in the practice of this invention. Indeed, the entire board system 21' could be lifted as a unit, e.g., by hydraulic cylinders positioned under the entire board system or by cables powered by cranes located in the rink's roof superstructure.

FIG. 3 also depicts an alternative method of lifting the arcuate left end zone dasher board portion (14, 15, 18) from the ice surface 12. This alternative method employs a cable array 17A, 17B and 17C that can be pulled upward by a cooperating array of powered cranes located in the superstructure (not shown) of the roof of the ice sport facility 10. Such a cable array (17A, 17B and 17C) will, for example, be used to lift the arcuate left end zone dasher board portion (14, 15, 18) when the dasher board portion is not mounted on the end zone apparatus 52. This would be the case where the alternative structure 46 is located well to the left of the left end zone (e.g., under a fan seating area on the left side of the ice rink). In such cases, the cable array 17A, 17B and 17C would lift the left arcuate portion (14, 15, 18) rather than its being lifted by the left end zone apparatus 52. Indeed, in such a case there would be no need for said apparatus 52.

Figure 4:
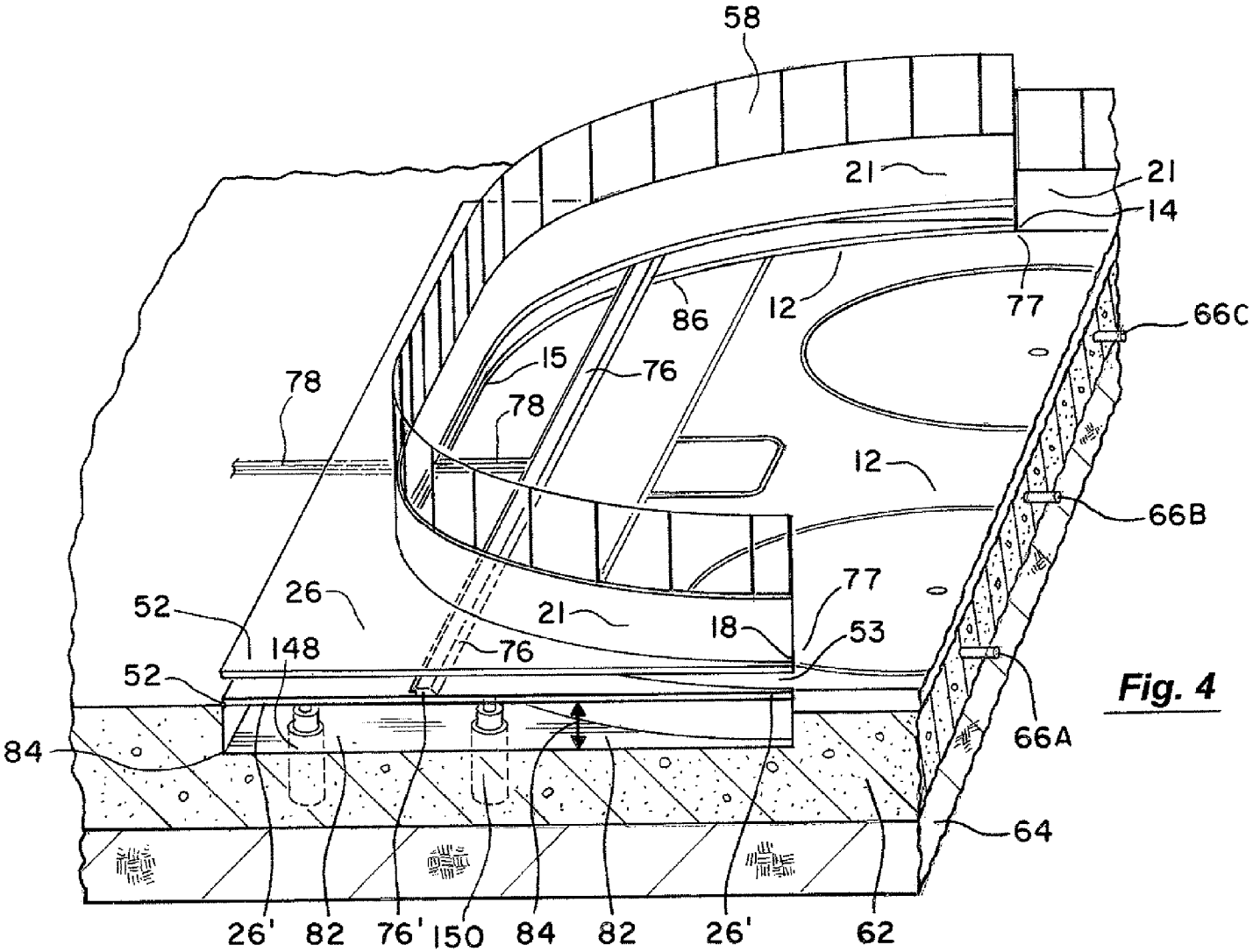
FIG. 4 shows the left arcuate end zone apparatus in its second (raised) vertical operating position.

FIG. 4 is also an enlarged view of the left end zone apparatus 52 shown in its raised or "up" position. It more fully illustrates certain structural details of said apparatus 52. For example, it shows the left top plate 26 previously discussed in its raised position. It also shows that the apparatus 52 has a left bottom plate 26' that can have, by way of example, a structure and configuration that is substantially the same as the left top plate 26. That is to say that it too can have a rectangular configuration on three sides and an arcuate fourth side. In order to better depict the cage-like nature of this left end zone apparatus 52, its vertical sides and vertical support structural elements have been removed from this view. In any case, it should be specifically noted that this left end zone apparatus 52 has an open side 53 that permits passage of the ice blade system 76 out of, and in to, the interior of the left end zone apparatus 52. This interior region can also be considered as the ice blade system's "home position." As previously noted, the coupling, locking, attaching, etc. of the ice blade system and the ice scoop system can take place inside the left end zone apparatus 52 or these operations can take place at some point 77 just outside of said apparatus 52.

Under the simplified and cut-away viewing circumstances presented by FIG. 4, the near end 76' of the ice shaving blade system 76 can also be better seen. For example, it can be seen that the length of the ice shaving blade system 76 is such that it may generally extend almost to any vertical side (not shown) of the left end zone apparatus 52. It also should be noted that the length of the ice shaving blade system 76 is such that in the operating position depicted in FIG. 4, the ice blade system 76 extends well beyond the bounds of the arcuate end zone region of the ice rink at this operating position. Again, the ice blade system 76 should be long enough to extend substantially over the widest width dimension 22 of the hockey rink's ice surface 12 (e.g., the 85 feet width of a regulation NHL rink). Indeed, in some embodiments of this invention hereinafter more fully described, the length of the ice shaving blade system 76 will be such that the ice blade system 76 extends even slightly beyond the 85 ft. side board to side board width of such an ice rink. This feature can provide an ice edging function that removes those ice fillets that often form between the vertical dasher boards 21 and the horizontal ice surface 12 to the previously noted vexation of ice hockey players. It might again be noted that the utilities depicted by item 78 could also be introduced at the near end 76' of the ice blade system 76 and/or at the opposing end of said ice blade system.

FIG. 4 also shows how the left end zone apparatus 52 can further reside in a left trench system 82. Such a left trench system 82 could, by way of example only, also have the rectangular/arcuate configuration of the left end zone apparatus 52. In many cases however, this trench 82 will be made much larger to accommodate various mechanical apparatus hereinafter more fully described. At the very least, the left trench system 82 will have a depth 84 that is at least sufficient to contain the left end zone apparatus 52 when it is in its down position e.g., as suggested in FIGS. 1 and 2. That is to say that the left trench system 82 should have a depth 84 such that the top surface of the top plate 26 can descend to a level at or near the top level of the ice surface 12 when it is in its down position.

Figure 5:
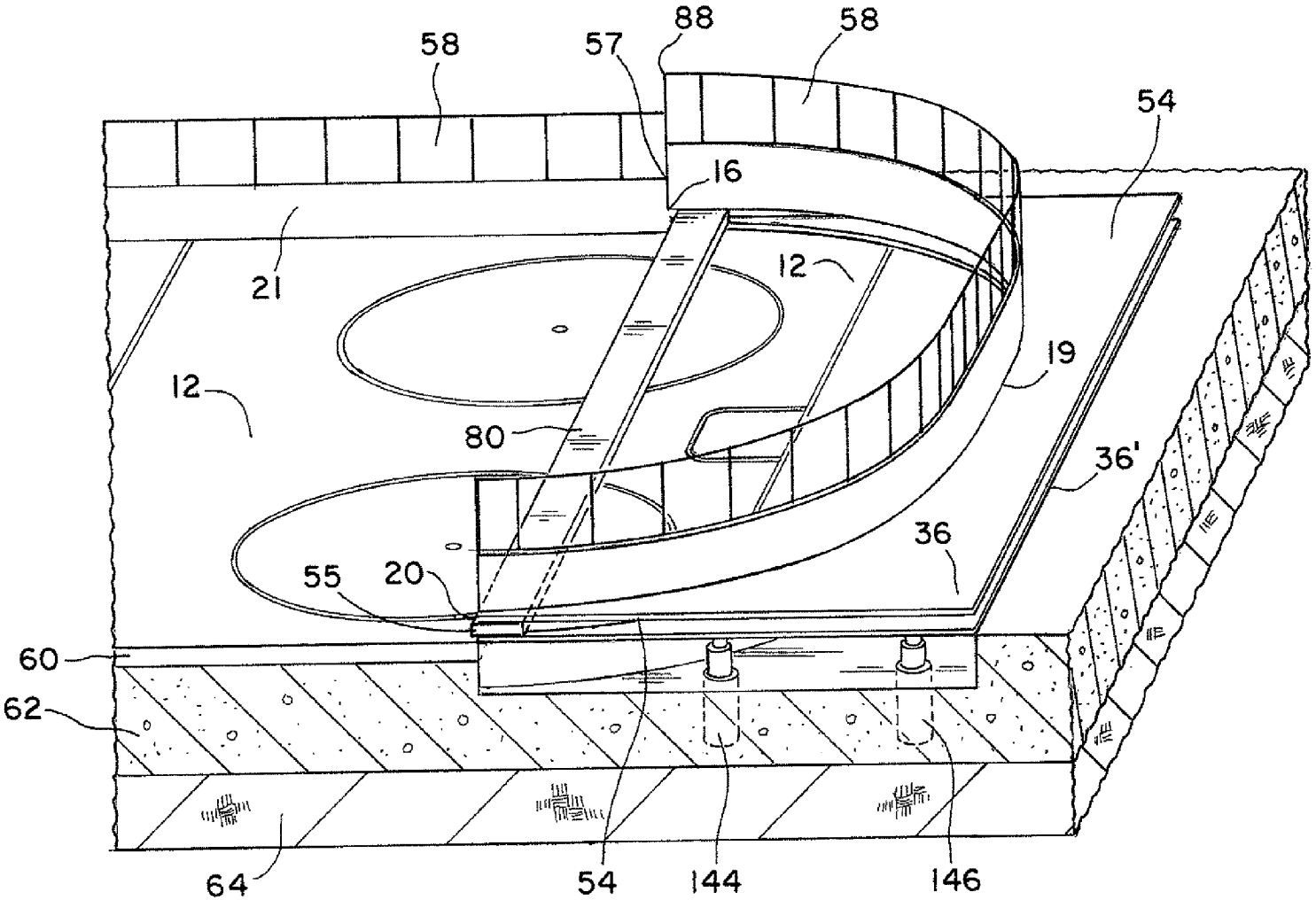
FIG. 5 shows the right arcuate end zone apparatus in its second (raised) vertical operating position.

FIG. 5 shows the right end zone apparatus 54 in its second or raised position. This apparatus 54 also can have a rectangular/arcuate configured bottom plate 36' that is comparable in size and shape to its top plate 36. Here again this right end zone apparatus 54 has a cage-like configuration having an open side 55 that will permit passage of the scoop system 80 in to, and out of, the right end zone apparatus 54. The interior of this end zone apparatus 54 could also be regarded as the "home position" of the ice scoop system 80. In FIG. 5 however, this ice scoop system 80 is shown in an operating position such that it is just starting to depart from the right end zone apparatus 54. As previously noted, this ice scoop system 80 might be associated with, or disassociated from, the ice blade system 76 inside of, or just outside of, the right end zone apparatus 54. It might also be noted here that, as shown in FIG. 3, the top level 88 of safety glass of the arcuate right end zone dasher board portion (16, 19, 20) is shown elevated above the top level 57 of the safety glass of the side board (14, 16). FIG. 5 also shows hydraulic devices 144 and 146 that can raise or lower the right end zone apparatus 54.

Figure 6:
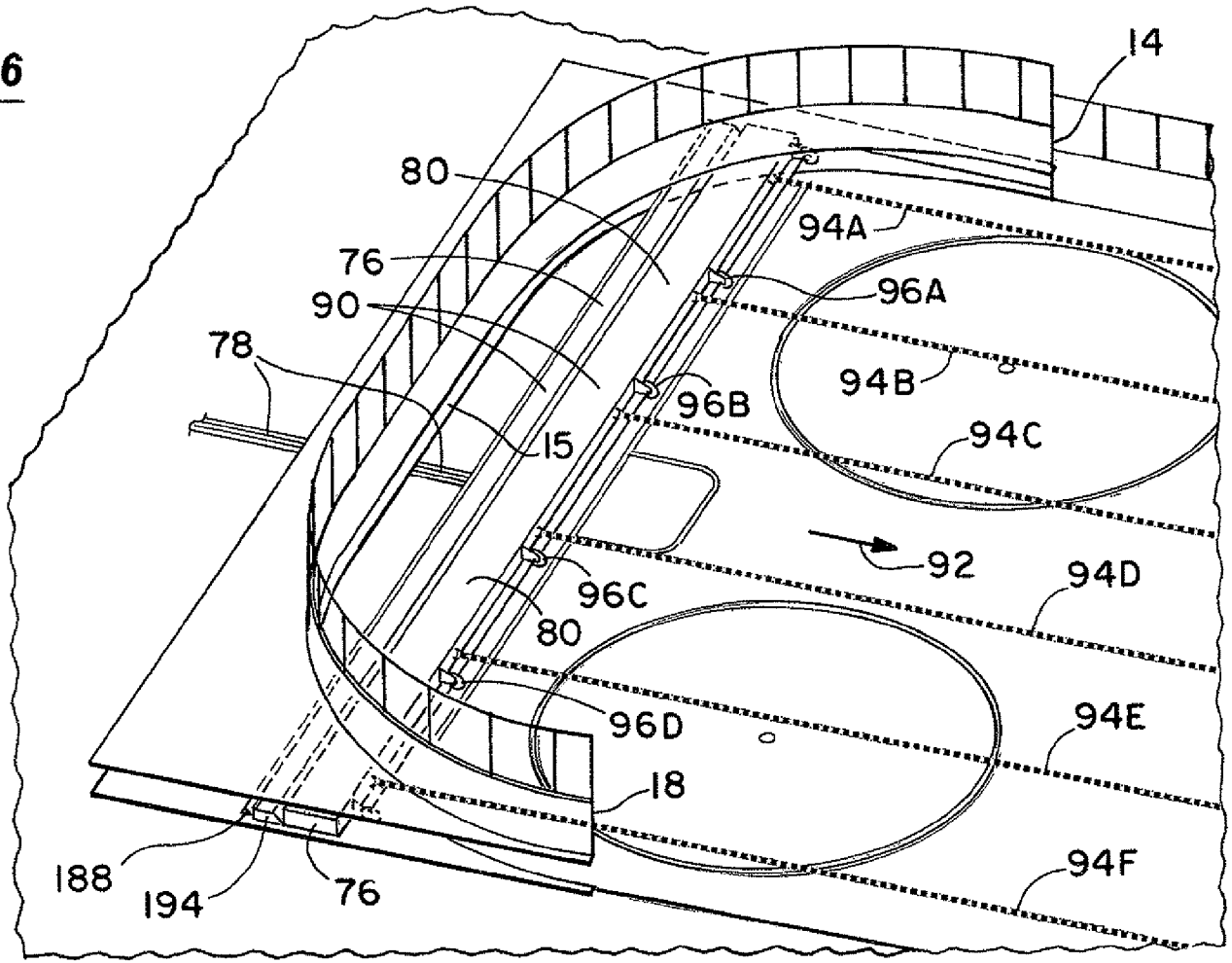
FIG. 6 shows the left arcuate end zone apparatus in its raised position and an ice shaving system and an ice scoop system being employed to shave the top surface of an ice surface.

FIG. 6 depicts the ice shaving blade system 76 and the ice scoop system 80 in a coupled relationship achieved by use of coupling attachment, locking mechanism, etc. devices not shown in this FIG. 6. Again, when so coupled/attached/locked to each other, the resulting system will be often herein referred to as a coupled ice blade/scoop system 90. The relative sizes of the ice shaving blade system 76 and the ice scoop system 80 are intended to suggest that the ice scoop system 80 will have an ice shavings holding capacity sufficient to hold all of the ice shavings created when the ice surface 12 is refurbished over its entire width and length (e.g., 85 ft.×200 ft. in the case of a National Hockey League-sized rink). For example, a 1/32 inch ice cut over a 85 ft.×200 ft. ice surface would produce only about 45 cubic feet of ice shavings. This amount of shavings could be readily held by an ice scoop system 80 that is about 4-6 inches high, 4-6 feet wide and about 85 feet long.

In FIG. 6, this coupled blade/scoop system 90 is shown being powered in an ice shaving direction 92 i.e., from left to right. By way of example only, the ice scoop system 80 is shown attached to a plurality of, or system of, powered tension creating devices 94A, 94B, 94C, 94D, 94E and 94F such as chains, cables, belts and the like whose left ends are attached to the ice scoop system 80. The opposing right ends of such tension creating devices are attached (via sprockets, reels, take-up devices and the like such as those shown in FIGS. 8A and 8B) to power creating devices (not shown in FIG. 6) such as electric motors, fuel driven (e.g., natural gas, propane) engines, hydraulic systems and the like that are capable of pulling the tensioning devices (94A-94F) to the right, which in this case is the ice shaving direction 92. An alternative method of powering the ice scoop system 80 would be to provide it with a plurality of powered, studded wheels 96(*a*), 96(*b*), 96(*c*), etc. that are capable of gaining sufficient traction on the ice surface 12 to pull the coupled blade/scoop system 90 in the ice shaving direction 92. Such powered wheels could also operate in, or along, the side boards of the ice rink.

Figure 7:
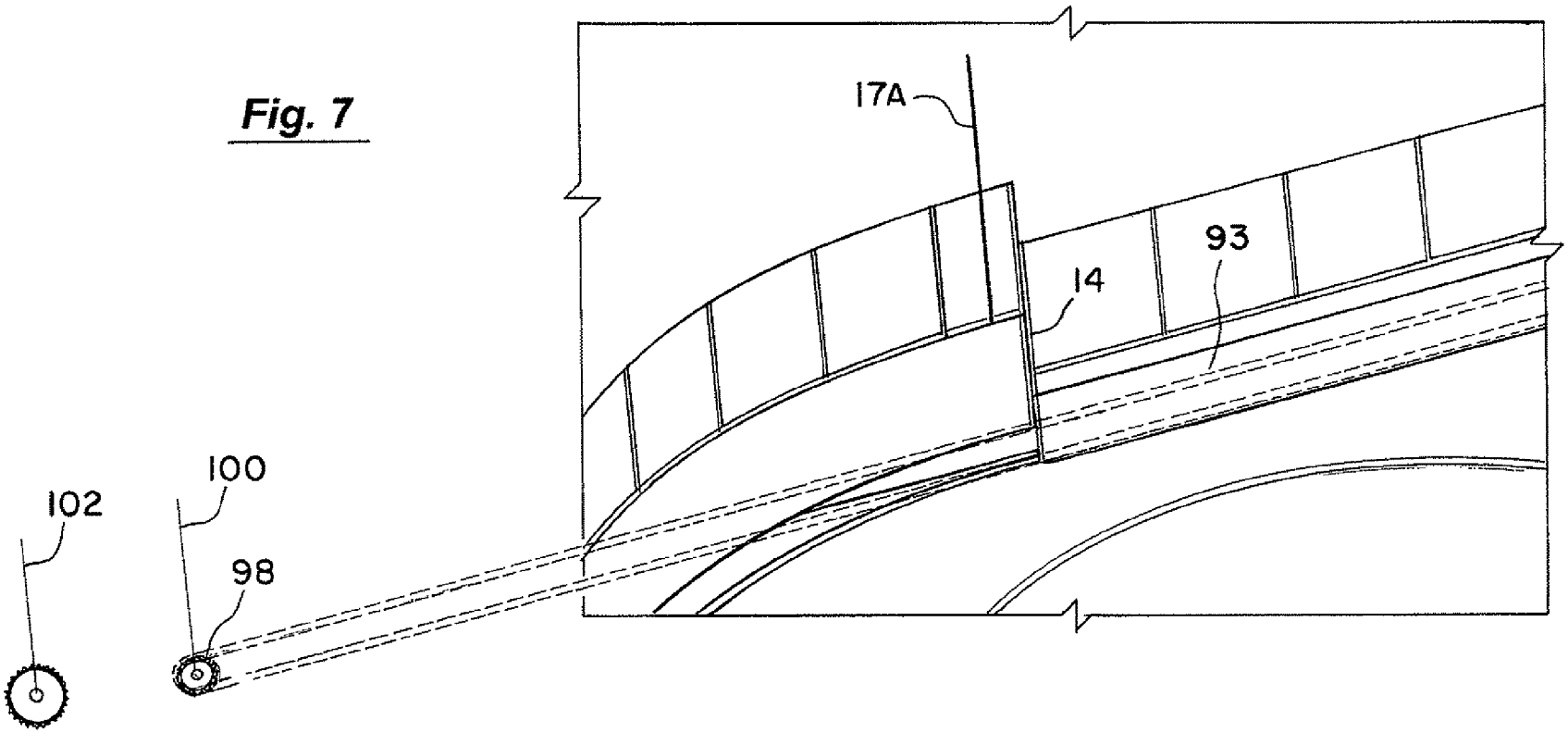
FIG. 7 shows an expanded view of the left arcuate end zone apparatus and a chain and sprocket system.

FIG. 7 shows a part of the left end zone portion (14, 15, 18) in its raised position. It depicts a kick plate 93 (whose function is hereinafter more fully explained) in its raised position. This allows a view of, and access to, a chain and sprocket system that can supply dynamic power to various components of this apparatus (e.g., its ice blade system, its ice scoop system, its docking bar system or even its printer system). FIG. 7 shows this dynamic power delivering system having a left end sprocket 98 having its mounting location 100 at a point that could be located in a trench such as the left trench system depicted as item 82 in FIG. 4. It could, for example, reside near the rear of the left end zone apparatus 52. In the alternative, the left end sprocket 98 could be located at a point 102 in the alternative structure 46 suggested in FIG. 1. Dynamic power delivering systems such as this sprocket and chain system (or a pulley and cable system, pulley and belt system) will be primarily used to return the ice blade system, the ice scoop system and the docking bar system to their respective home positions. However, if made rugged and powerful enough they could also be used to pull the ice blade system (and the ice scoop system) in their ice shaving (or collecting) operations. FIG. 7 also depicts a situation wherein the left end zone portion (14, 15, 18) has been lifted to its up position by cable 17A (in conjunction with cables 17B and 17C) rather than by an end zone apparatus such as end zone apparatus 52.

Figure 8A:
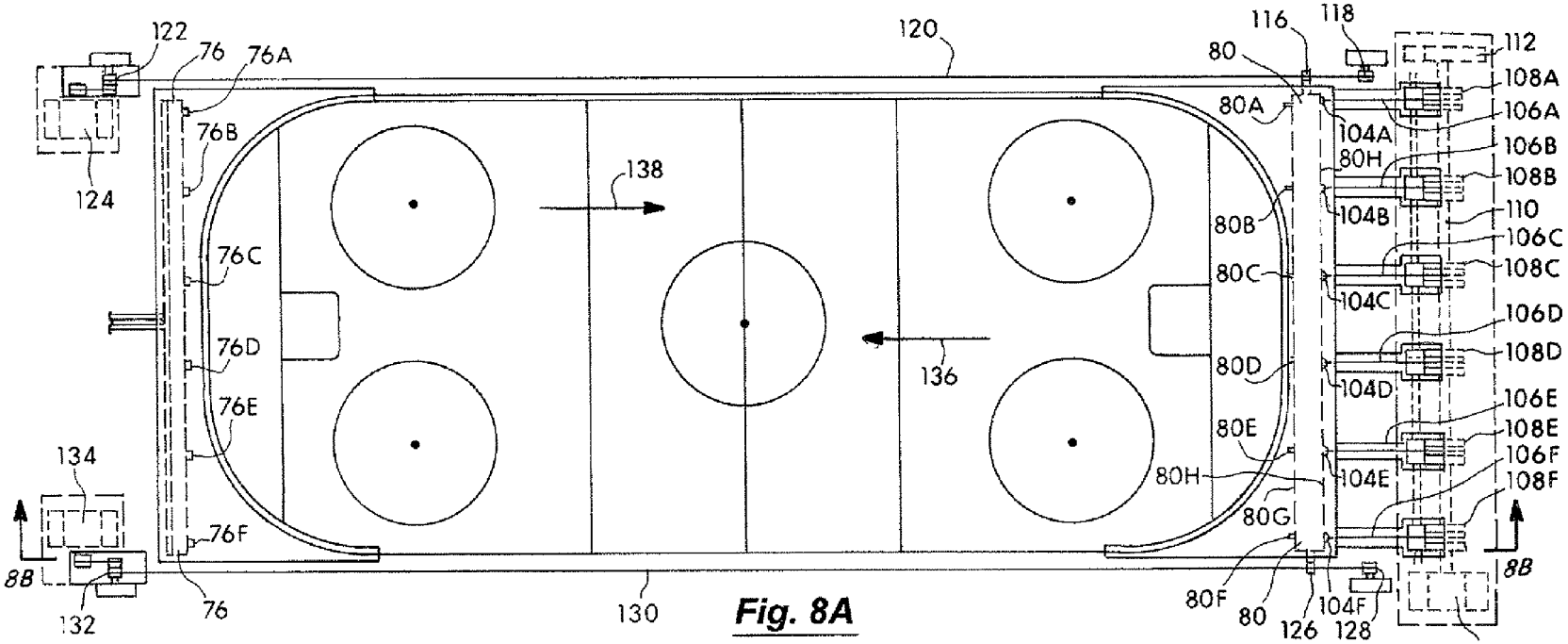
FIG. 8A is a plan view of an ice rink showing various working components and powering systems.
Figure 8B:
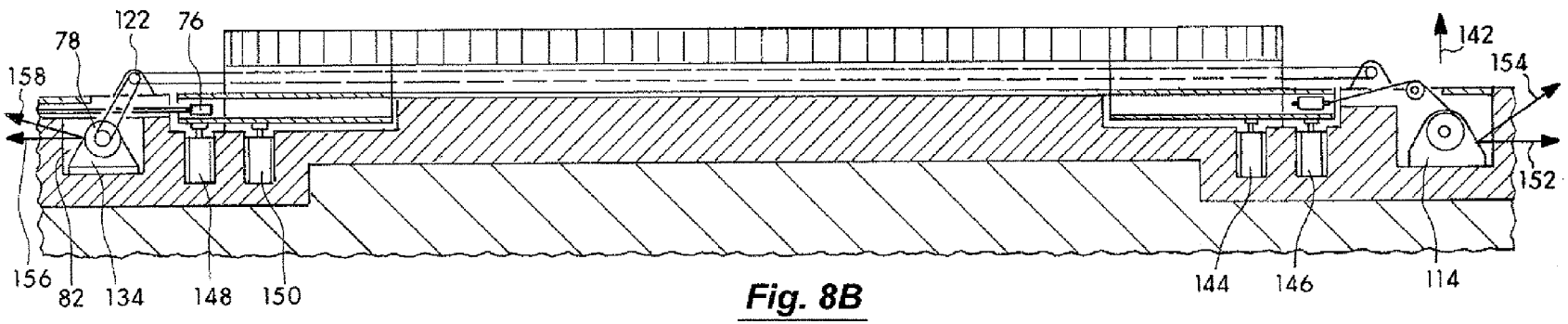
FIG. 8B is an elevation view of FIG. 8A.

FIG. 8A is a partially cut-away, plan view of yet another embodiment of the present invention. FIG. 8B is its corresponding, partially cut-away elevation view. The plan view 8A shows an ice blade system 76 residing in its home position under top plate 26 of left end zone apparatus 52. The ice blade system 76 is shown provided with a series of coupling components 76A, 76B, 76C, 76D, 76E and 76F. They will couple, interconnect, lock with, etc. a counterpart series of coupling components 80A, 80B, 80C, 80D, 80E and 80F that are attached to a front side 80G of the ice scooping device 80. The rear side 80H of the ice scoop system 80 is shown provided with an array of cable attachment devices 104A-104F. These cable attachment devices are respectively attached to cables 106A-106F that are wound upon a series of counterpart cable take-up reels 108A-108F. All of these take-up reels 108A-108F are mounted on a common drive shaft 110. One end of this common drive shaft 110 is journaled in a journaling device 112. The other end of the drive shaft 110 is connected to the drive shaft of a power delivering device 114 such as an electric motor, a fueled engine and the like.

As was previously explained with respect to one embodiment of this invention, the ice scoop system 80 can be attached (at point 116) to a first dynamic power delivering apparatus having a first pulley head 118, a looped cable 120 and a second, powered pulley head 122. This pulley head can be powered by motor 124. The other end of the scoop 80 is similarly attached (at point 126) to a second dynamic power delivering apparatus having a first pulley head 128, a looped cable 130, and a second powered pulley head 132 that is powered by motor 134. These two dynamic power delivering apparatus, in effect, pull the entire ice scoop system 80 (to the left as indicated by direction arrow 136) across the entire 200 ft. length of the ice rink. The cables 106A-106F that are attached to said ice scoop system 80 are pulled across the ice as well. Upon arriving at the left end of the ice rink the coupling, locking, attaching, etc. devices 76A-76F of the ice blade system 76 are coupled, locked, mated, etc. with counterpart coupling devices 80A-80F that are affixed to the ice scoop system 80.

The resulting coupled ice blade/scoop system 90 is then powered back across the length of the ice (in an ice shaving direction 138). The power needed to carry out the ice shaving operation is supplied by the cable system 106A-106F. That is to say that the power source 114 (e.g., an electrical motor that will power its drive shaft 110 in a clockwise direction, as seen from the rear side 142 of the motor). This action will, in turn, power the drive shaft 110, and the take-up reels 108A-108F that are commonly mounted to it, in a clockwise direction. This action will place a tension, pulling force, etc. upon the cable array 106A-106F that pulls the ice blade/scoop system 90 to the right side of the ice rink. There, the ice shavings collected in the ice scoop 80 can be disposed of (by dumping, use of a conveyor belt, heating, augering, brushing, etc.) by use of apparatus that is not shown in FIG. 8A. The ice blade system 76 and the ice scoop system 80 are then uncoupled. Thereafter, the ice blade system 76 is engaged with the dynamic power delivering system e.g., with cables 120 and 130 and returned to its home position in the left end zone apparatus 52.

The partially cut away side view 8B, shows the ice scoop system 80 in a home position that is near the rear end of the right end zone apparatus 54. It also shows the locations of certain powered lifting/lowering devices 144 and 146 (e.g., hydraulic cylinders) that can be used to raise and lower the right end zone apparatus 54. Comparable powered lifting devices 148 and 150 are shown in positions suited to raising and lowering the left end zone apparatus 52.

The entire motor, drive shaft, pulley array and journal system shown in FIGS. 8A and 8B could be located in the alternative structure 48 shown in FIG. 1. Indeed, the right end zone apparatus (if used) and the ice scoop 80 could have their "home position" in the alternative structure 48 as well. This change of location is suggested by direction arrow 152. A second direction arrow 154 leading from the power source 114 to about ground level is intended to indicate that, if the power source 114 and all of the mechanical equipment associated with it (the drive shaft 110, the journal 112, the pulleys 118 and 128, the cable array 106A-106F and so on) could also be relocated to the alternative structure 48 at ground level. That is to say that there would be no need to have these items of equipment below ground level and thereby making the apparatus of this patent disclosure more simple to construct, operate and maintain. This circumstance would follow from the fact that the structure 48 itself can be substantially at ice surface level and hidden from public view (e.g., by placing said alternative structure 48 under spectator seating (not shown) on the right side of the sports facility 10).

A similar opportunity to "hide" the components of Applicant's ice refurbishing apparatus in the structure 46 previously discussed—rather than "hiding" them under plate 26 also exists. That is to say that the motors and cables shown in trench 82 can be moved to the alternative structure 46. This transfer of location is suggested by direction arrow 156. And here again, as suggested by direction arrow 158, components shown below ice level on the left side of this apparatus could be employed at ice level, if they were housed in alternative structure 46. Again, said structure 46 can be hidden from view under spectator seating on the left side of the ice sports facility 10. Indeed, the ice blade system 76 can have its "home position" in the alternative structure 46 as well. This use of alternative structure 46 could even completely eliminate a need for the left end zone apparatus 52.

Figure 9:
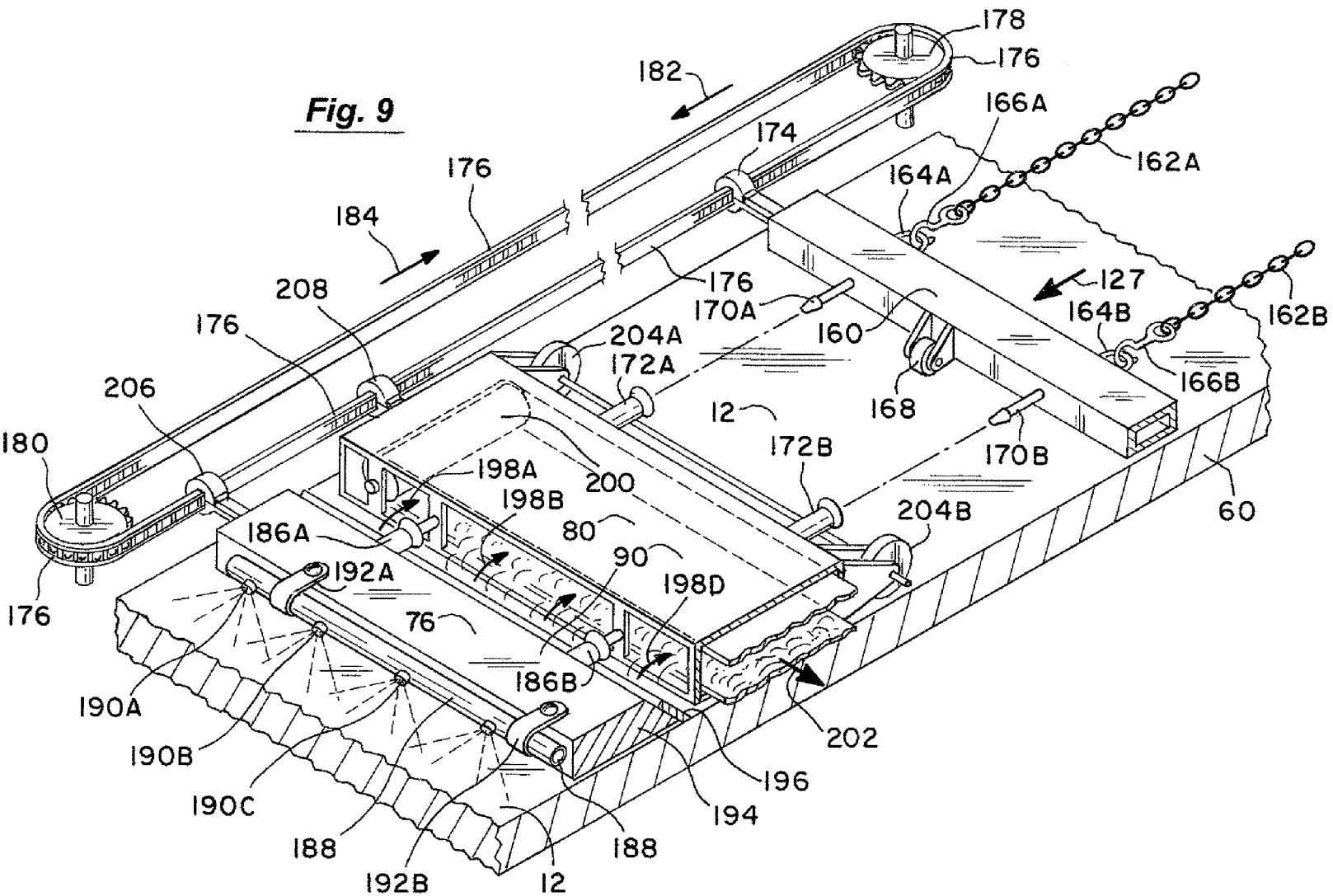
FIG. 9 shows a perspective view of an embodiment of this invention wherein an ice blade system, an ice scoop system and a docking system are shown associated with a chain and sprocket dynamic power delivery system.

FIG. 9 depicts an embodiment of this invention wherein certain mechanical details are better illustrated. For example it shows a portion of the ice blade system 76, a portion of the ice scoop system 80, and a portion of a docking bar system 160 provided with coupling, locking attachment mechanisms for coupling/uncoupling these components to each other. The docking bar 160 of FIG. 9 is shown attached to a chain array 162A, 162B, etc. To this end, the docking bar 160 is shown having eye components 164A, 164B, etc. that respectively couple with hook components 166A, 166B, etc. This representation can be regarded as being symbolic of a wide variety of coupling systems that, most probably, will be operated by air pressure or hydraulic pressure devices rather than the simple mechanical hooks and eyes shown in this figure.

The docking bar 160 is shown provided with a wheel 168 to facilitate movement of said docking bar system 160 over the ice surface 12. The docking bar system 160 is also shown provided with a series of coupling devices 170A, 170B, etc. will engage with the cooperating coupling devices 172A, 172B, etc. of the ice scoop system 80. FIG. 9 also shows the docking bar system 160 provided with a clamp device 174 that is capable of clamping to, and unclamping from, a drive chain 176. This drive chain 176 is part of a sprocket and chain system having a right sprocket 178 and a left sprocket 180. At least one of these sprockets will be powered by a powering device not shown. In effect, the chain 176 forms a loop around these two sprockets 178 and 180. The chain 176 can be driven in a first direction 182 or an opposing direction by reversing the direction of a motor (not shown) driving one of the two sprockets.

FIG. 9 also shows the ice blade system 76 provided with an array of coupling components 186A, 186B, etc. that can couple with cooperating coupling devices (not shown) on the ice scoop 80. A water dispensing system 188 is shown attached to the ice blade system 76. It is shown provided with a series of water spraying nozzles 190A, 190B, 190C, etc. Other possible water dispensing devices could include (but not be limited to) misting nozzle systems, squeegee systems and/or water saturated absorbent material systems. This water dispensing device 188 can be attached to the ice blade system 76 by attachment devices 192A, 192B, etc. The ice blade system 76 is generally comprised of a shoe component 194 and a blade component 196. The shoe component 194 is preferably made of a strong, dense metal such as steel so that it place a great deal of weight over the ice shaving blade component 196. FIG. 9 depicts the ice shavings created by the action of the ice blade component 196 being "scooped up" (see direction arrows 198A, 198B, 198C, etc.) and placed on a conveyance means such as, by way of example only, a conveyor belt system 200 located inside of the ice scoop system 80. In this FIG. 9, these shavings are shown (by use of direction arrow 202) being generally directed toward a central region of the ice scoop system 80. The ice scoop system 80 is also shown provided with wheels 204A, 204B that can facilitate travel of the ice scoop system 80 over the ice surface 12. Indeed, such wheels could also be powered.

The ice blade system 80 is also shown, by way of example, provided with a clamping mechanism 206 capable of engaging with the link components of the drive chain system 176 (such as those commonly used to power motorcycle wheels). The clamping mechanism 206 depicted here should be regarded as symbolic rather than literal. When this clamp is engaged with the chain 176 and said chain is driven in an appropriate direction, the coupled ice blade system 76 and ice scoop system will be dynamically driven in a given direction, (e.g., toward a home position of the coupled ice blade/scoop system) by powering the chain 176 in direction 184.

The docking bar system 174 is shown with a comparable chain clamping device 174. However, in a dynamic powering of the coupled ice blade/scoop system depicted in FIG. 9 to its home position (e.g., leftward), the docking bar system's chain clamping device 174 will not be engaged with the chain 176. Hence, the docking bar system 160 can remain (for example) in its home position while the ice blade/scoop system 190 is being dynamically pulled to its home position.

Figure 10:
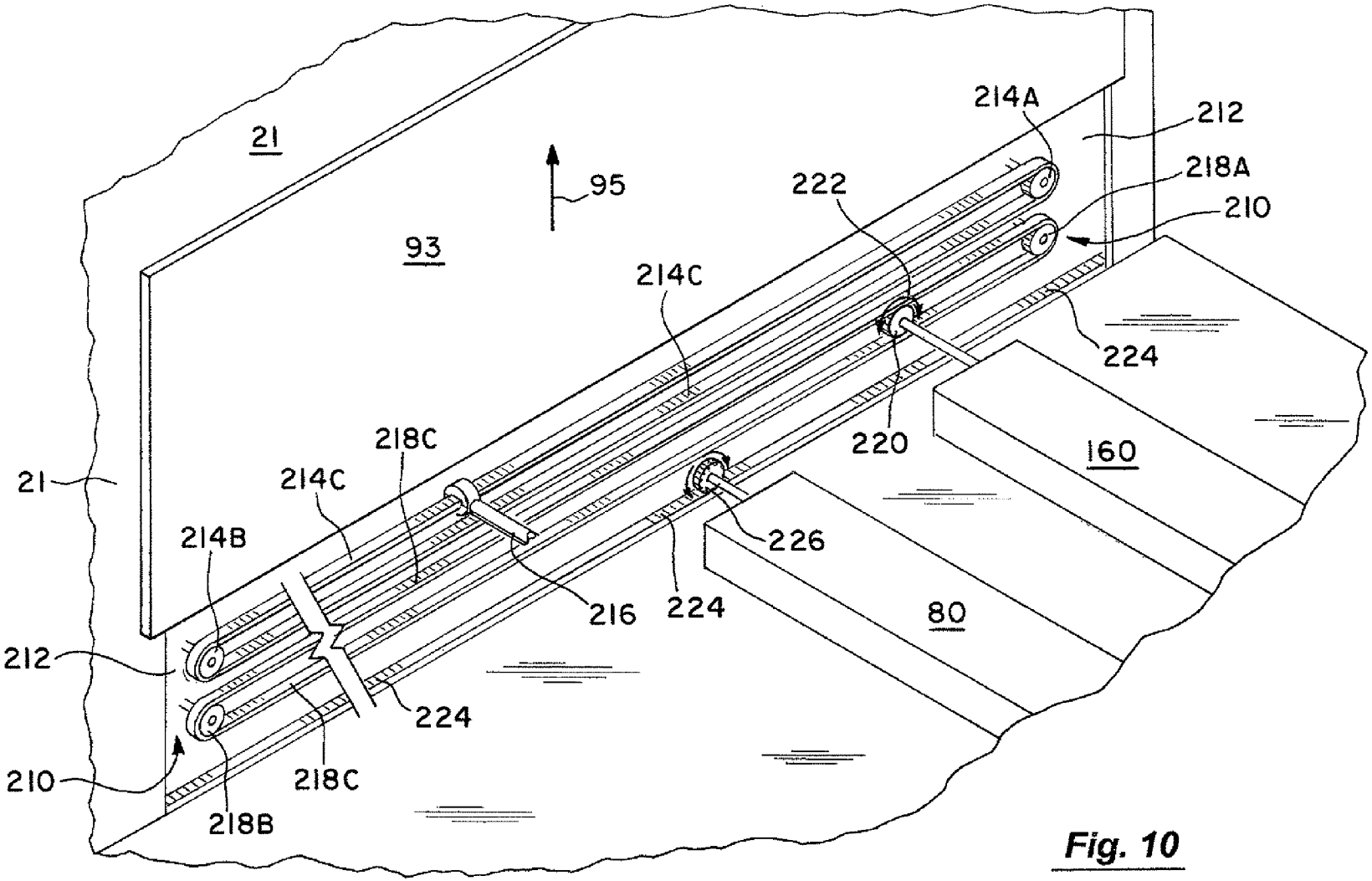
FIG. 10 shows certain side boards of an ice rink provided with a kick plate that is raised to expose various apparatus components of Applicant's invention.

FIG. 10 depicts the presence of a representative hollow space 210 near the base of a side board region 21. This hollow space 210 and its contents have been made visible by virtue of the fact that a kick plate 93 that normally covers the open end 212 of this hollow space 210 has been raised to an up position 95. The hollow space 210 is shown containing two separate and distinct sprocket and chain systems. The first sprocket and chain system is comprised of sprocket 214A and sprocket 214B around which a chain 214C is looped. One of these sprockets will be powered by a power source not shown. A clamp 216 is shown attached to the cable 214C. This situation is intended to depict that some component (an ice blade system, an ice scoop system, a docking bar system, or a printer system) could be attached to this clamp 216 and therefore operate independently relative to whatever the second sprocket and chain system is doing.

The second (bottom) sprocket and chain system shown in FIG. 10 is comprised of sprocket 218A, sprocket 218B and a chain 218C. A chain 218C is looped over the two sprockets. Here again, one of these two sprockets will be powered (by a power source not shown). This sprocket and chain system 218A, 218B, 218C can be used to specifically illustrate a mode of operation whereby a component of Applicant's apparatus (e.g., its docking bar 160) can be powered from left to right or from right to left. Applicant sometimes refers to this powering method as moving a powered sprocket (or a powered pinion) across a static chain system. This powering method can be carried out by first locking one or both of the sprockets 218A and/or 218B in place. That is to say that one or both of these sprockets is prevented from rotating on its axle. Thereafter a powered sprocket 220 that is attached to the docking bar system 160, and positioned between the upper part of the chain 218C and the lower part of said chain loop 218C, can be rotated clockwise or counterclockwise (see two headed arrow 222) to power the docking bar system either to the right or to the left. In order to do this however, the powered sprocket 220 must be smaller than sprockets 218A and 218B. Moreover, it can only engage with the lower span of the chain 218C. In other words, the powered sprocket 220 does not engage with the upper span of chain 218C. In most cases, a comparable action will be carried on the opposite side (not shown) of the docking bar system 160.

FIG. 10 also illustrates yet another way of moving a component (e.g., its blade, scoop, docking bar, printer) over the ice surface 12. Here, a rack component 224 of a rack and pinion system is shown affixed to the floor of the hollow space 210. A powered pinion 226 is shown attached to (by way of example) an ice scoop system 80. This pinion 226 can rotate (clockwise or counterclockwise) over the fixed rack component 224 and thereby move the ice scoop system 80 from right to left or from left to right. Here again, the other end of the ice scoop system (not shown) will be provided with a comparable rack and pinion mechanism.

Figure 11:
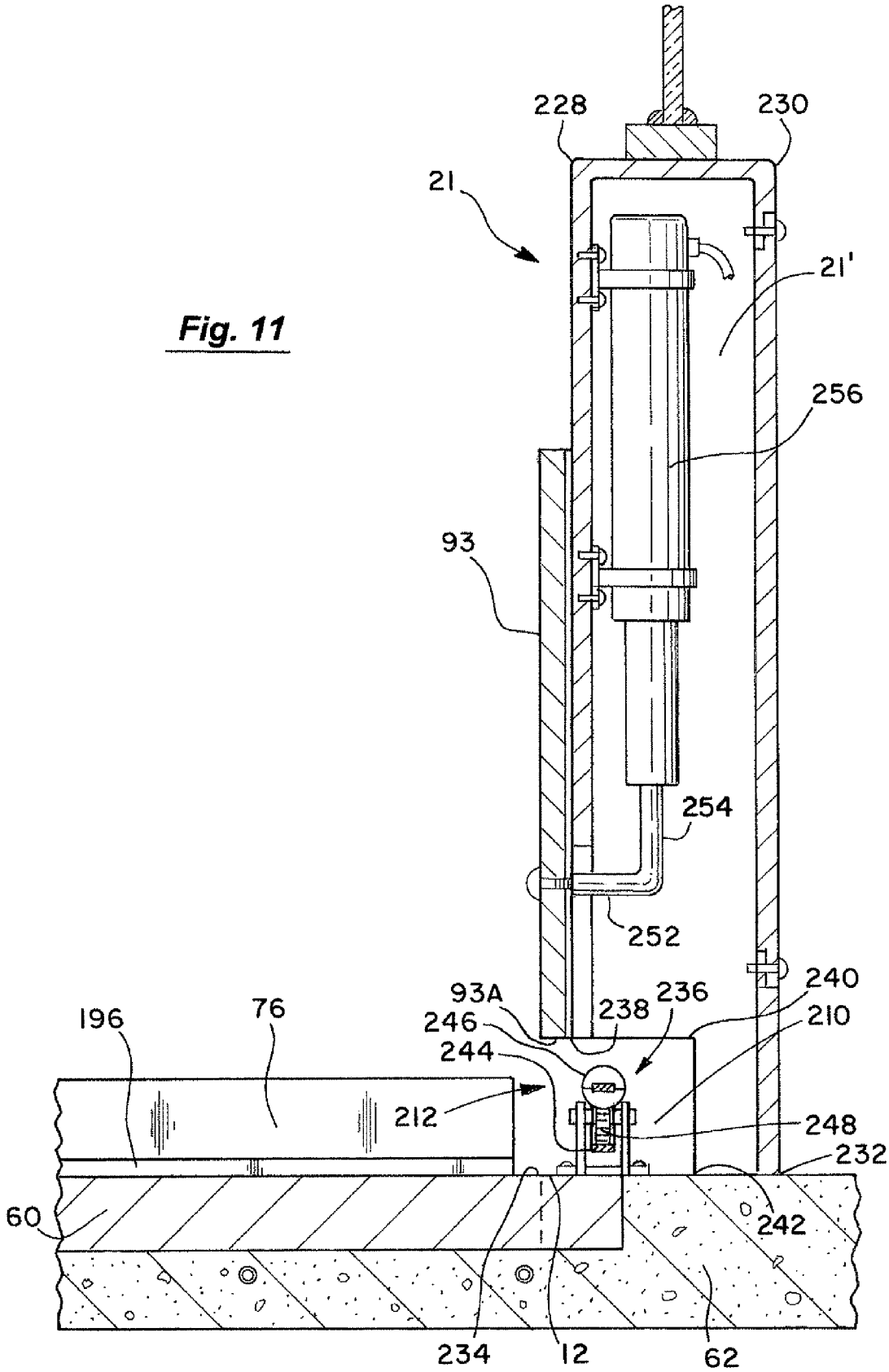
FIG. 11 shows a cut-away side view the side boards of an ice rink provided with a kick plate that can be raised and lowered.

FIG. 11 is a cross sectional view of a portion of a side board system 21 as seen from the right side of the ice rink shown in FIG. 1. Such side boards are usually covered by a scratch resistant cover (not shown) e.g., made of polyethylene, polypropylene, etc. Be that as it may, this side board cross section 21' is shown having a generally rectangular configuration whose corners are depicted by item numbers 228, 230, 232 and 234. The corner suggested by item number 234 is not, however, a true corner, but rather an imaginary one. This is because the lower left region of the side board cross section 21' is shown provided with a hollow space 210 having a generally rectangular configuration. Its corners are depicted by item numbers 238, 240, 242 and 234. The primary function of this hollow space 210 is to house various mechanical components of the ice refurbishing apparatus of this patent disclosure.

For example, this hollow region 210 is shown housing a chain and sprocket device 244 that is shown engaged to a clamp device 246. In this end view, however only the edge of the sprocket is visible and this view of the sprocket is visually complicated by the fact a chain passes over that sprocket. In any case, the sprocket 248 is shown mounted in a vertical orientation. It could however be mounted in a horizontal orientation such as that illustrated in FIG. 9. It might also be noted here that a pulley and cable system, or a pulley and timing belt system, could replace the sprocket and chain system 244 shown in this FIG. 11.

Next, it should be noted that in FIG. 11, the kick plate 93 can be regarded as being in its full "up" position (i.e., its bottom surface 93A is at the same elevation as the top surface 238-240 of the hollow space 210). The open face side 212 (from 238-234) of the hollow space 210 is open. This open state exposes the sprocket/chain device 244 for mechanical connections pursuant to the various operations of this apparatus, for repairs, etc. of any mechanical equipment 236 contained in said hollow space 210. In its full "down" position the bottom surface 93A of the kick plate 93 will come to rest upon the top surface 12 of the ice slab 60. This position of the kick plate 93 will fully house the sprocket/chain system 244 in the hollow space 210 in the side boards 21. To these ends the kick plate 93 is shown having a horizontal arm 252 that is, in turn, attached to a vertical rod 254 that terminates in a powering device 256 such as a hydraulic cylinder or a pneumatic cylinder or the like. The function of this powering device 256 is to lift and lower the kick plate 93 to desired elevations.

Figure 12:
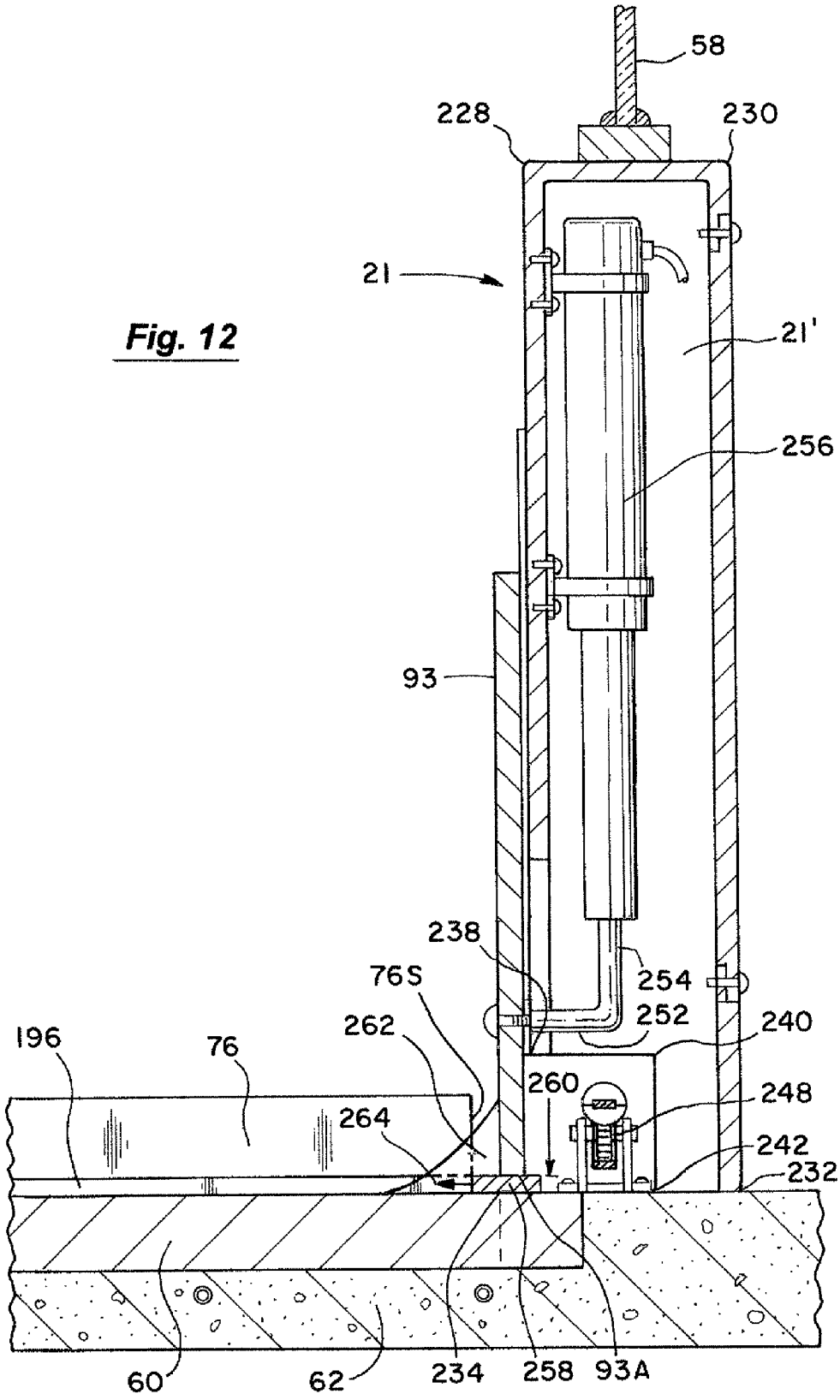
FIG. 12 is another view of side boards shown in FIG. 11 and wherein an ice edging tool is shown being employed to remove a fillet shaped mound of ice that has built up along the kick plate.

FIG. 12 shows the kick plate 93 in a second operating position. This second operating position will bring the bottom 93A of the kick plate 93 to a level 260, such that an ice edging tool 258 can fit under the bottom 93A of the kick plate 93. In effect, the edging tool 258 enters a bottom region of the hollow interior region 210. This will allow the edging tool 258 to completely scrape off any ice fillet 262 that may have formed between the vertical kick plate 93 and the horizontal ice surface 12. Since the vertical height or thickness of the edging tool 258 is only slightly less than the vertical height 260 of the bottom 93A of the kick plate 93, very little of the ice scrapings from the ice fillet 262 will enter the hollow region 210. Such an edging tool 258 can be statically mounted on the side 76S of the ice shaving blade system 76. This edging tool 258 can also be dynamically mounted on the ice blade system 76 so that said tool can be drawn (as depicted by direction arrow 264) into an interior region of said ice blade system 76. It might also be noted that such a kick plate 93 could be mechanically raised by a wedging action of wedge-like device working its way under the bottom 93A of the kick plate 93. For example, a wedge-like component on the docking bar may be used to mechanically raise the kick plate 93 to some desired elevation. Such a wedge lifted kick plate can, for example, be returned to its home ("down") position using a spring device such as that depicted in FIG. 16.

Figure 13:
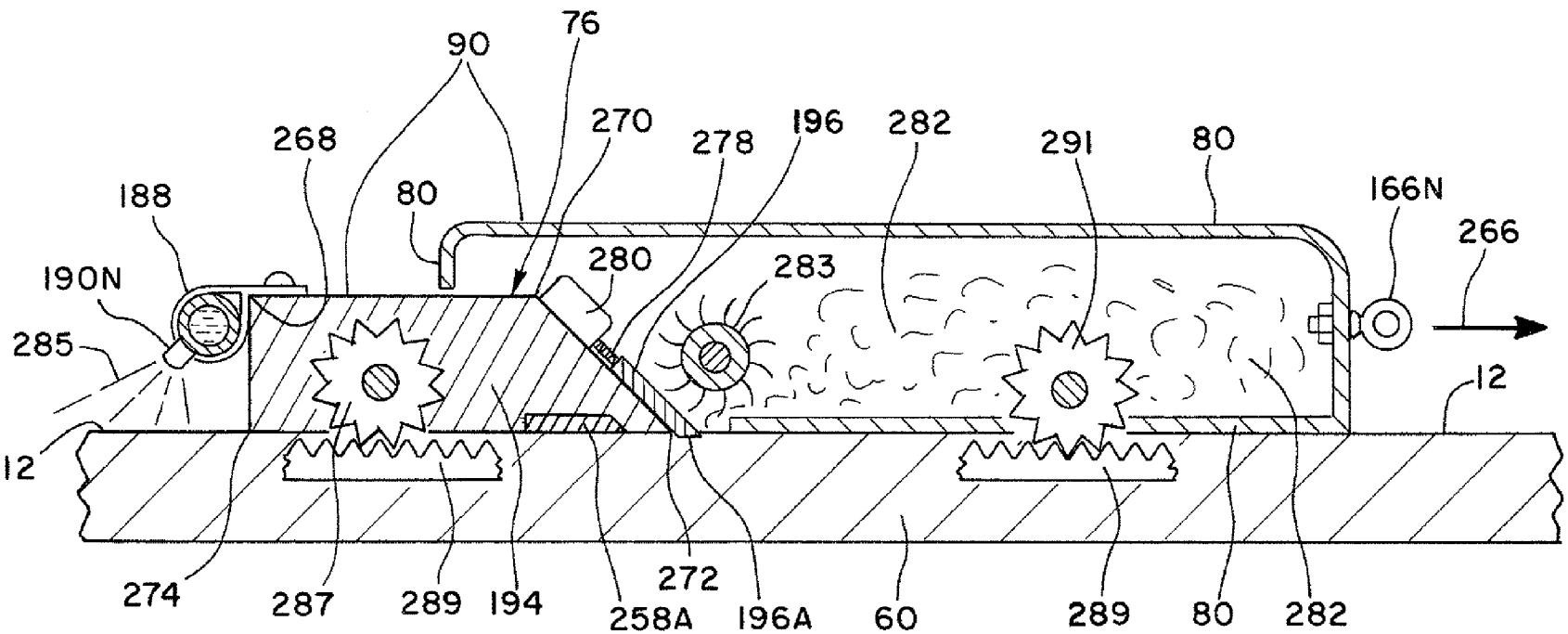
FIG. 13 is a side view (shown in partial cut-away) of an ice shaving blade and an ice scoop in a coupled relationship as they are powered in an ice shaving direction (from left to right).

FIG. 13 is a partially cut away side, perspective view of an embodiment of this invention wherein the ice shaving blade system 76 and the ice scoop system 80 are coupled together to form a coupled ice blade/scoop system 90 that performs an ice shaving/ice scooping operation as the coupled blade/scoop system 90 is pulled in the rightward (e.g., ice shaving) direction generally suggested by direction arrow 266. The ice blade system 76 has a "shoe" component 194 whose corners are depicted by items numbers 268, 270, 272 and 274. This shoe 194 also carries a blade component 196 on the shoe's inclined plane 270-272. Again, the shoe 194 component of the ice blade system 76 will be made of a strong, dense material such as steel because one of its functions is to supply weight over the ice shaving blade 196 in order to get a more uniform ice cut. This shoe 194 may also be provided with an ice edging tool 258A. And as previously noted, such an ice edging tool 258A may be statically mounted to the side of the shoe 194 or it may exit from, and retract to, a holding location located within the body of the shoe 194. This blade 196 can be mounted statically or dynamically on the inclined plane portion 270-272 of the shoe 194. For example, the spring 278 and block 280, depiction of FIG. 13 are intended to suggest a dynamic capability of raising or lowering the ice shaving depth of the tip 196A of the blade component 196 by means of a servo device. Thus, the dynamic apparatus associated with the blade 196 can be adjusted such that the blade's ice shaving tip 196A can be adjusted as it progresses over the ice surface 12.

The ice shavings 282 created by the shaving operation are shown collecting inside the body of the ice scoop 80. This collection of these ice shavings 282 can be facilitated by ice shavings moving devices such as the brush 283 shown therein. The ice scoop 80 is also shown as having a hook 166N that is attached to a tensioning device (not shown) such as a chain, cable or belt that is attached to a power delivering device (not shown in FIG. 13) such as the motor 114 shown in FIGS. 8A and 8B. The ice shavings 282 may be removed from the ice scoop in various ways including turning the scoop upside down to dump the ice shavings into a receiving pit, heating the ice to melt it (e.g., by hot air), flushing the inside of the ice scoop system 80 with a liquid such as hot or cold water, paddling, auguring, brushing, using a conveyor belt or pushing the shaved ice out of the side of the scoop to a shavings disposal pit. A water dispensing device 188 having a nozzle 190N is shown dispensing water 285 on to the ice surface 12. Next it might be noted that, by way of example only, the ice blade system 76 is shown provided with a powered pinion 287 that can mechanically cooperate with a rack 289. The ice scoop system 80 is shown provided with a comparable powered pinion 291.

Figure 14:
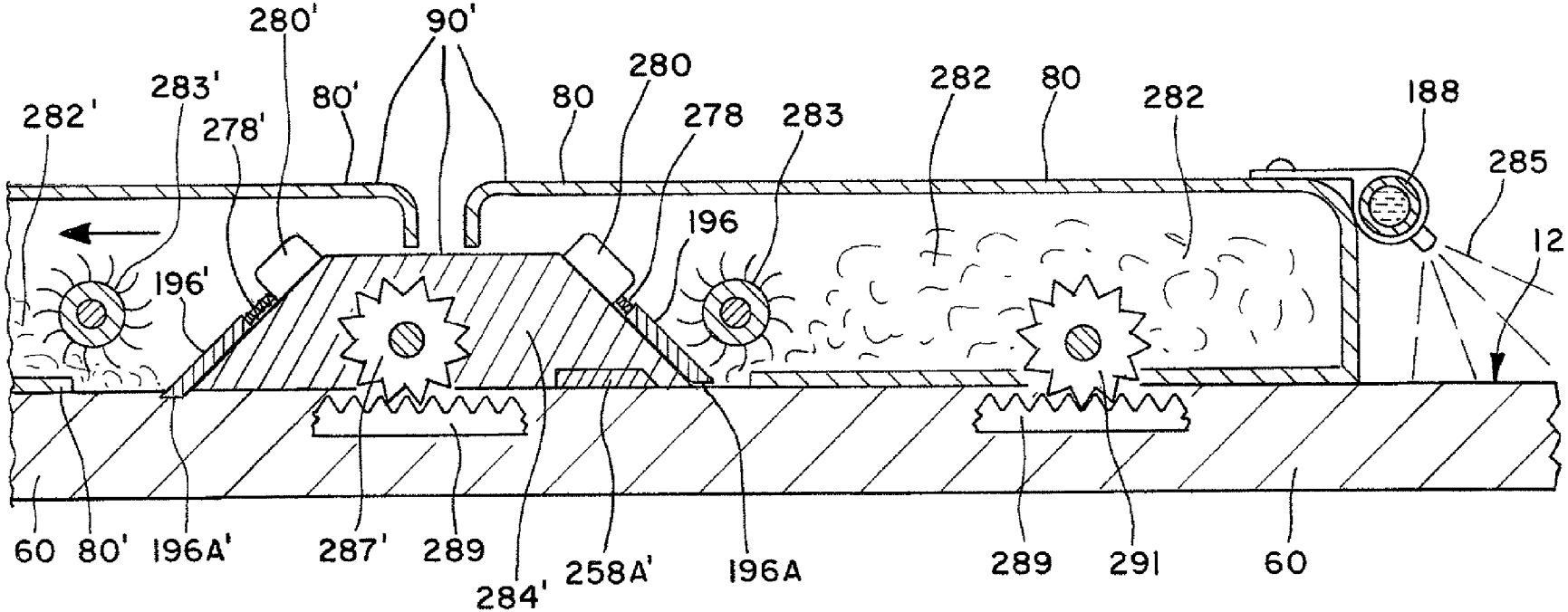
FIG. 14 is a side cut away view of an ice shaving blade system having two distinct ice shaving blades.

FIG. 14 shows an ice shaving blade system 76 having a shoe 284' having two blade surfaces, i.e., blade 196 on the right side of the shoe 284' and blade 196' on its left side. By way of example only, the ice shaving blade system of FIG. 14 is shown provided with two separate ice scoop systems 80 and 80' (a single ice scoop system could be employed as well). Thus, the first blade 196 could, for example, be employed to make a "rough" (e.g., ¼ inch) ice shaving cut, as that blade is powered in a first ice shaving direction (e.g., from left to right). The second ice shaving blade 196' could then be employed to make a "fine" (e.g., 1/64 inch) ice shaving cut as that blade 196' is powered in a second opposing ice shaving direction (e.g., from right to left). This shoe 284' could likewise be equipped with an ice edging tool 258A'.

Figure 15:
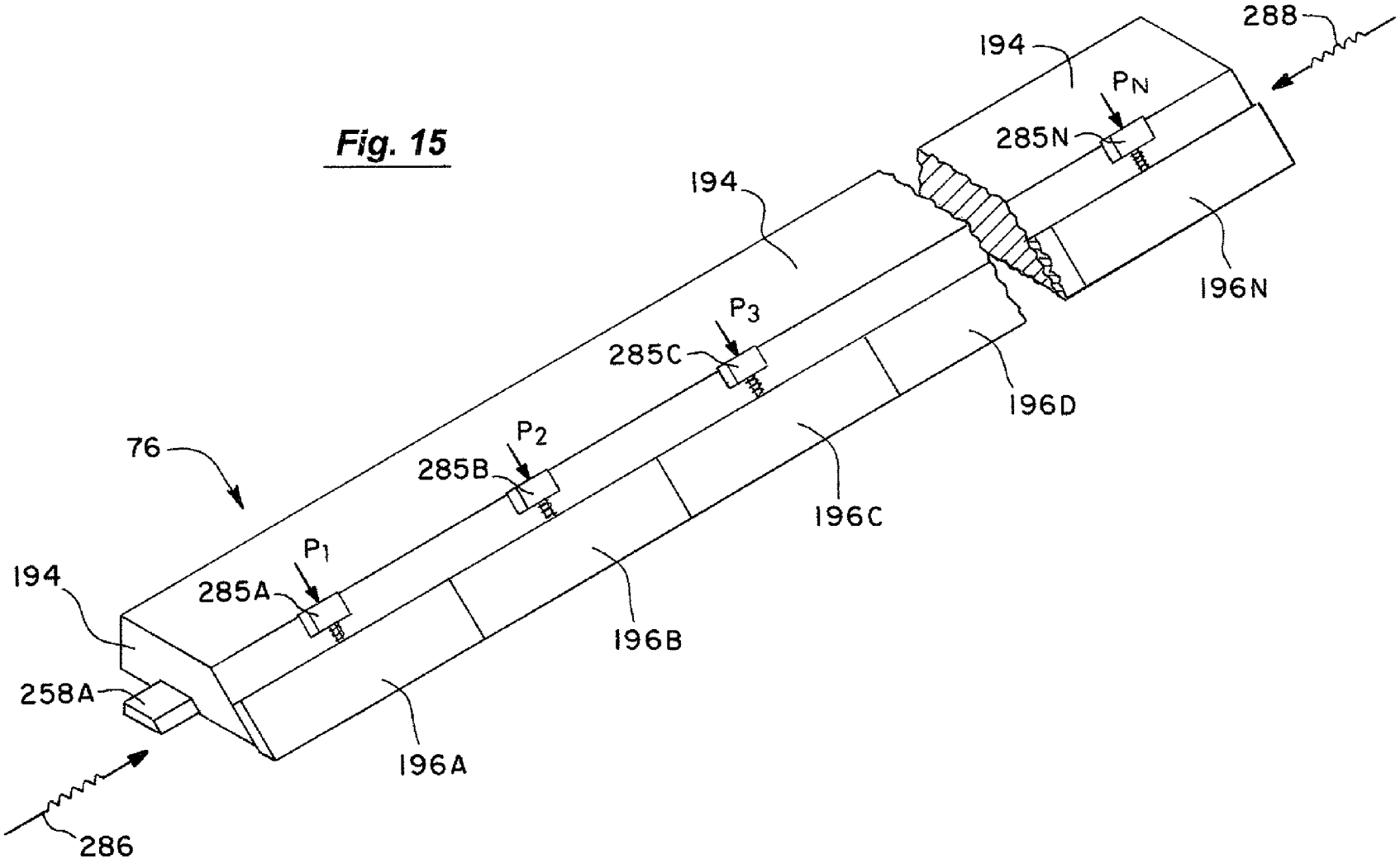
FIG. 15 is a schematic of an ice blade system comprised of a series of dynamically adjustable blade components.

FIG. 15 shows an ice blade system comprised of a series of blade components 196A, 196B, 196C, etc. whose ice shaving depth can be individually adjusted (e.g., by servo mechanisms 285A-285N or by stepper systems or by manually adjusted cap screw systems) e.g., under the guidance of a laser beam system 286-288 in ways known to those skilled in the servo control arts. In the alternative, the device for measuring the height of the blades along an 85 ft. span could be a wire tensioning cable that is tautly drawn across the 85 ft. span of the blade. Through use of such devices, differing downward pressures $P_1$, $P_2$ . . . $P_N$ can be delivered to the individual blades 196A-196N. Thus, this arrangement could, for example, compensate for any sag in the middle of the 85 ft. blade span owing to its own weight. Compensation for uneven ice surfaces could be made as well by this method of individually adjusting the ice shaving depth of the blade components 196A-196N. It might also be noted in passing here that the reaction time of such a servo system may be an important factor in limiting the speed of the ice shaving blade 76 over the ice surface 12.

In an alternative embodiment of this invention, the cutting blade is fixed at the level of a weighted heavy skate and a laser system or mechanical feeler or finger measures the surface of the ice at specific intervals along the 85-foot length (or other "entire dimension") of the ice surface. A mechanical valve connected to the fingers or PLC (computer or programmable logic controller) adjusts the water dispensing (e.g., by spraying, misting, squeegeeing, use of water saturated absorbent material systems, etc.) intensity of the deposited water at one or more specific locations on the overall ice surface that lie below their respective surrounding ice surfaces. That is to say that ice which is thinner in a specific area will receive more water on a given pass of the water dispensing apparatus and thus be raised for subsequent passes in an effort to produce ice at a fixed constant thickness across not just the width of the ice surface but its length as well. This all goes to say that, in this embodiment of the invention, water dispensing intensity (water volume dispensed per unit time, and hence water volume laid down per unit of surface area of the ice surface being refurbished) is used to adjust ice thickness—as opposed to use of blade height adjustments.

Figure 16:
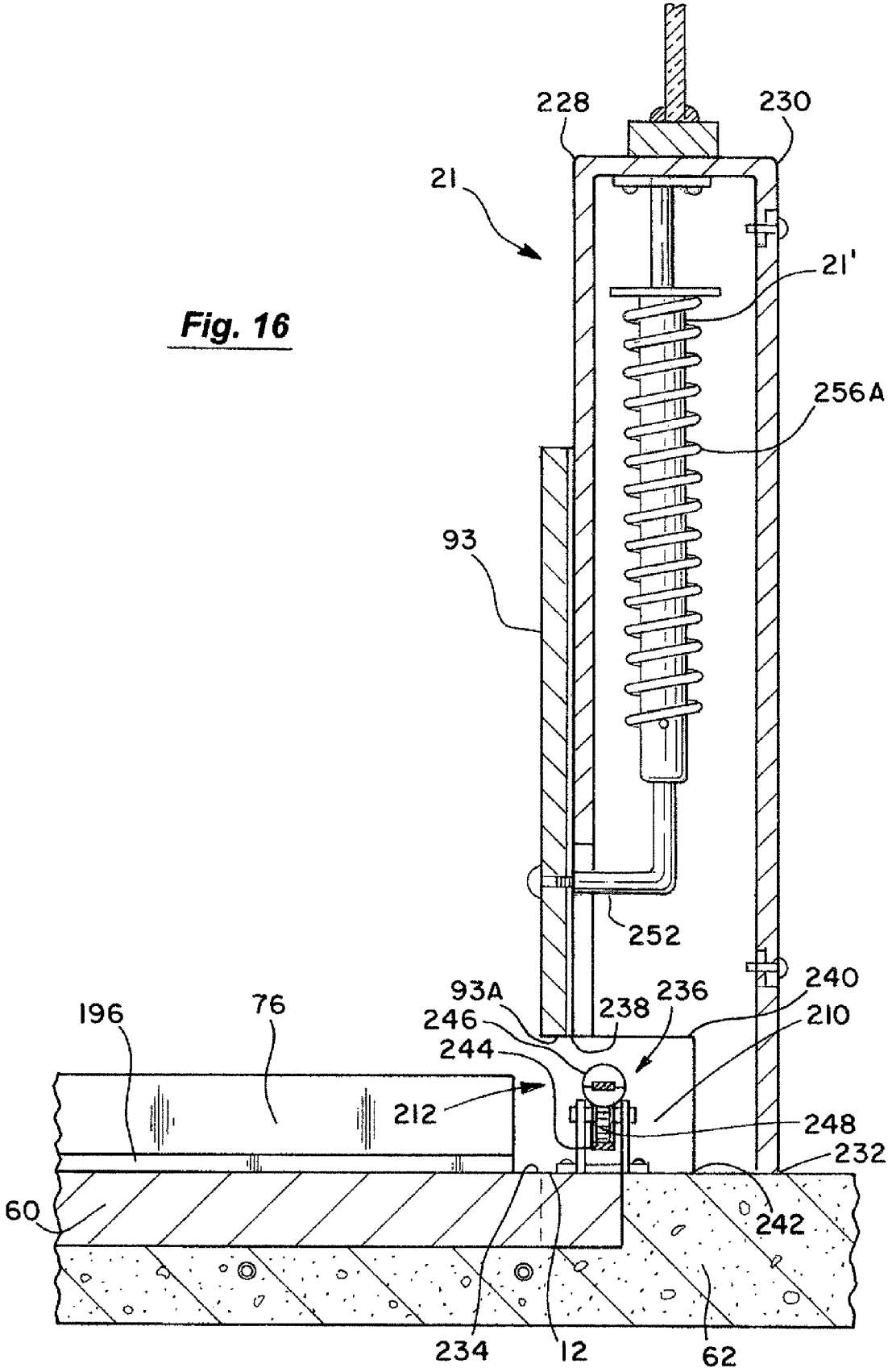
FIG. 16 is another cut-away side view of the side boards of an ice rink having a kick plate that can be raised and lowered by a spring device.

FIG. 16 is an alternative embodiment of the side board system 21 shown in FIG. 11. In this alternative embodiment, the kick plate powering device is a spring system 256A that can raise/lower the kick plate 93.

Figure 17:
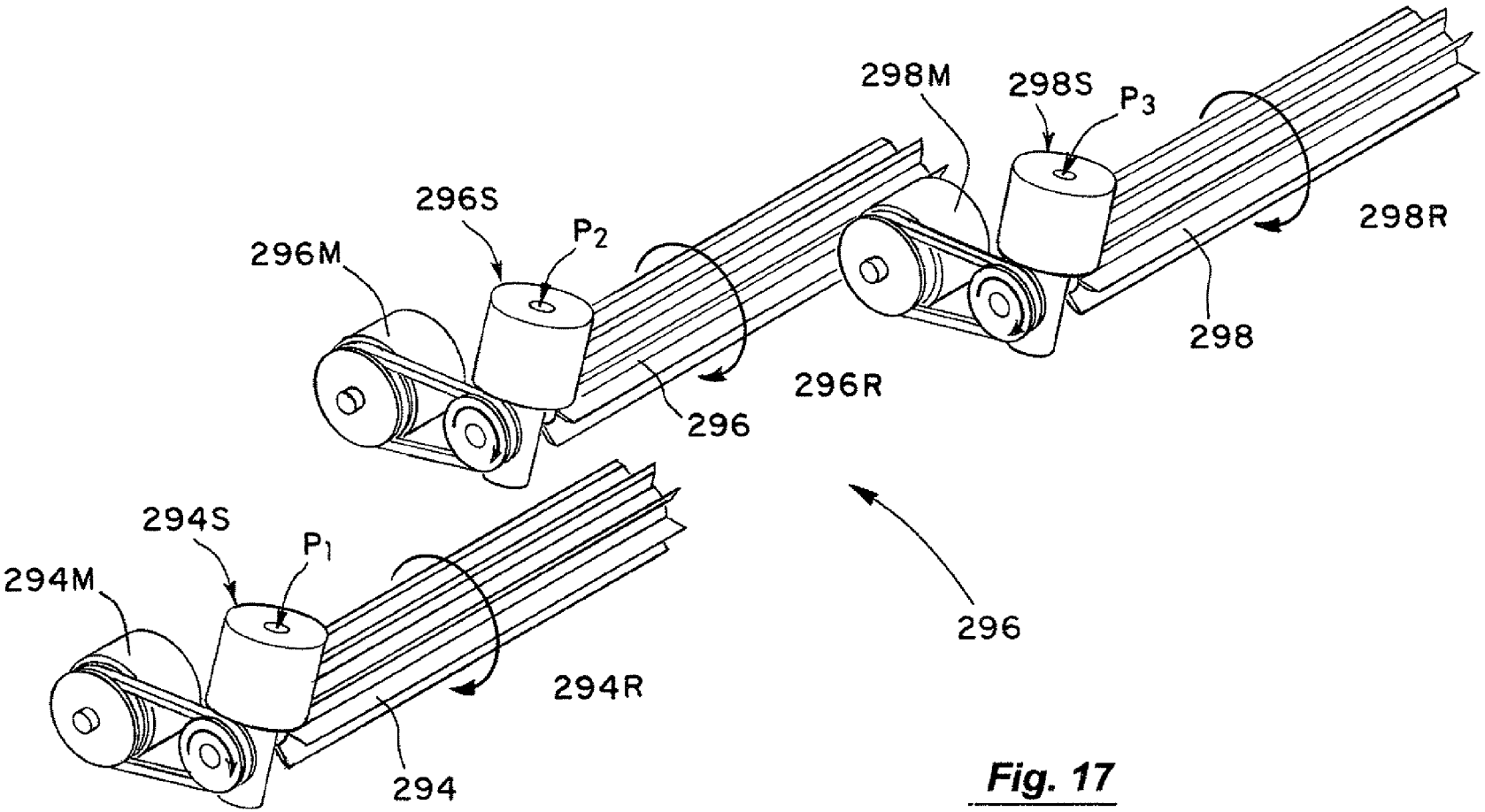
FIG. 17 is a perspective view of an ice shaving blade comprised of a series of circulating ice shaving blades.

FIG. 17 also shows an alternative embodiment of this invention wherein the ice blade system is a rotary ice blade system. Such a system could, for example, be comprised of a series of rotary powered ice cutting blades 294, 296, 298, etc. Each of these rotary blades is shown provided with its own respective motor 294M, 296M and 298M, etc. that drives these blades in their respective rotary directions 294R, 296R, 298R, etc. Moreover, each of the blades is shown provided with a respective servo mechanism 294S, 296S, 298S, etc. that is capable of raising/lowering (e.g., by varying the pressure $P_1$, $P_2$, $P_3$, etc. on the appropriate blade) the ice cutting depth of each blade independently.

Figures 18A, 18B:
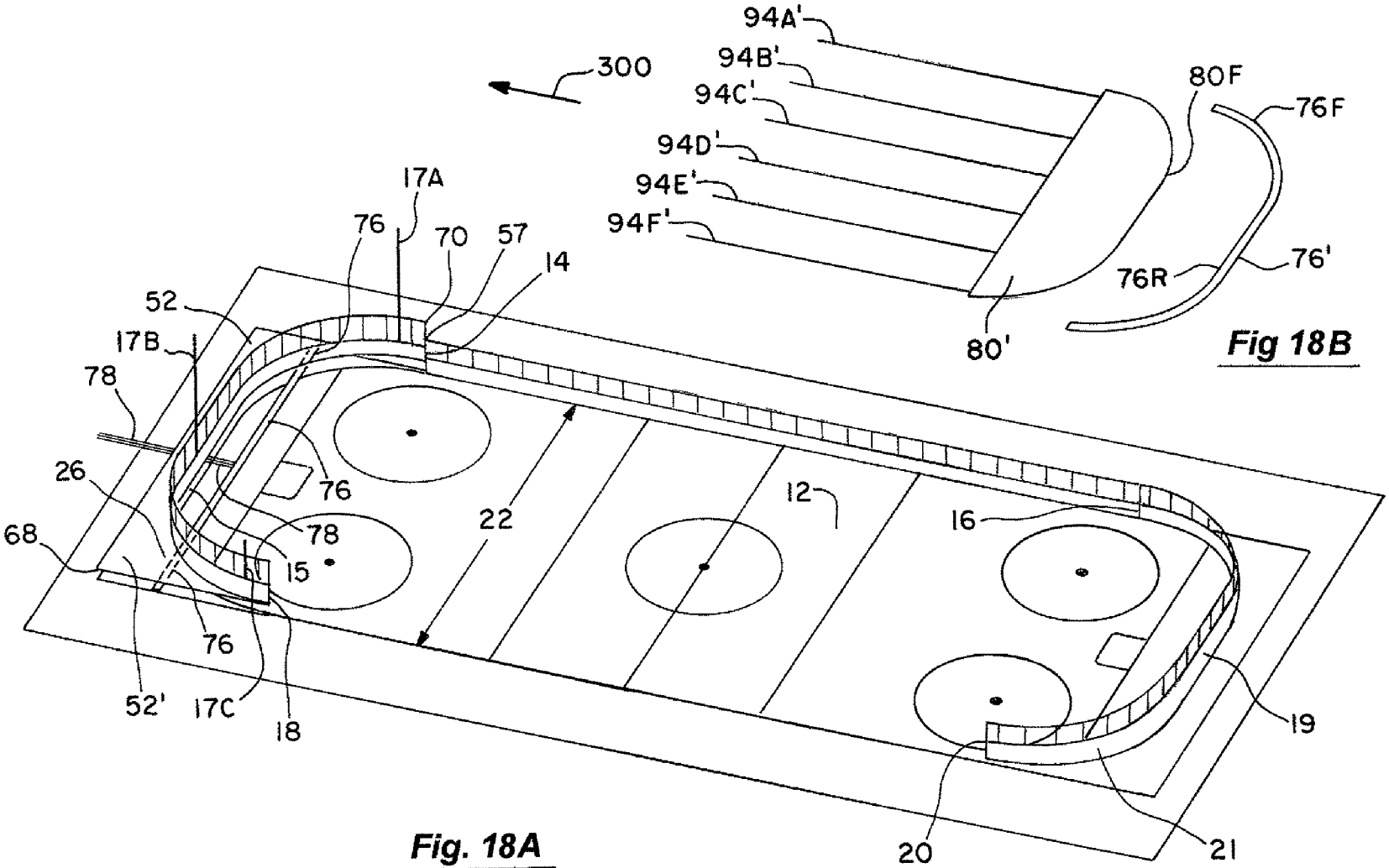
FIG. 18A is a perspective view of an ice rink having end zones adapted to use of a curved blade and curved scoop.
FIG. 18B is a detail of a curved blade, curved scoop system.

FIG. 18 illustrates another embodiment of this invention wherein a curved ice blade system 76' and curved ice scoop system 80' are employed. The size and curvature of the front end 76F of the curved blade system 80' is substantially the same as the size and curvature of the right end zone region (16, 19, 20) of the ice rink. The sizes and curvature of the rear edge 76R of the curved ice blade system 80' is substantially the same as the size and curvature of the front edge 80F of the curved ice scoop system 80'. Such a curved ice blade system 76' and curved ice scoop system 80' could be housed in an end zone apparatus such as left end zone apparatus 52'. The curved blade 80' could be separately housed in the left end zone apparatus 52', or it could be housed in said apparatus 52' in a coupled relationship with the curved ice scoop system 80'. Thus, the curved blade system 76' and the curved ice scoop system 80' could be separately conveyed (e.g., by dynamic powering devices located behind kick plates in the side boards) to the right end zone of the ice rink and then coupled, or the coupled curved ice blade system 76' and the curved ice scoop system 80' could be conveyed (e.g., by dynamic powering devices located in the side boards) to the right end zone (16, 19, 20) of the ice rink. In such a system, the arcuate left end zone portion (14, 15, 18) of the boards 21 could be capable of being raised and lowered as heretofore described. However, in cases where such a curved ice blade system 761 and a curved ice scoop system 80' are employed, the arcuate right end zone portion (16, 19, 20) of the boards 21 need not be raised. Thus the previously described right end zone apparatus 54 need not be employed. If the arcuate right end zone portion (16, 19, 20) is not raiseable, then the lower regions of the arcuate right end zone portion of the boards will have to be provided with kick plates that can be raised and lowered (e.g., in the manner depicted for the side kick plates illustrated in FIGS. 11, 12 and 16) to admit the front edge 76F of the curved ice blade system 76'.

In any case, a powered tensioning system e.g., chains, cables, belts (94F', 94E', 94D', 94C', 94B' and 94A) is shown attached to the curved ice scoop system. Thus, the coupled, curved ice scoop and ice blade can be powered back (see direction arrow 300) to the left end zone in an ice shaving operation. After arriving at the left end zone, the ice shavings in the curved scoop 80' are disposed of (in any of the various ways heretofore described) and the curved ice scoop system 80' and curved ice blade system 76' are rehoused in the left end zone apparatus 52'. A device for dispensing water on to the shaved ice surface can be attached to the rear of the curved ice shaving blade system 76' or a separate and distinct water dispensing device (not shown in FIG. 18) can follow the coupled scoop/blade system as it travels in direction 300 back to the left end zone apparatus 52' where the ice scoop system, the ice shaving blade system and the water dispensing device are all housed.

The above patent disclosure sets forth a number of embodiments of the present invention that are described in detail herein, especially with respect to the accompanying drawings. Those skilled in this art will however further appreciate that various changes, modifications, other structural arrangements, and other method oriented embodiments could be practiced under the teachings of the present invention without departing from its scope as set forth in the following claims.

Thus, having disclosed this invention, what is claimed is:

1. An apparatus for refurbishing an ice surface, said apparatus comprising:

(a) an ice blade system capable of shaving a layer of ice substantially across an entire dimension of the ice surface;

(b) an ice scoop system capable of collecting ice shavings created by shaving the layer of ice substantially across the entire dimension of the ice surface;

(c) a device for powering the ice blade system substantially across the entire dimension of the ice surface in an ice shaving direction;

(d) a device for powering the ice scoop system substantially across the entire dimension of the ice surface in the ice shaving direction;

(e) a device for dispensing water over substantially the entire dimension of the ice surface after the ice surface has been shaved;

(f) a device for powering the ice blade system to a home position after an ice shaving operation has been completed;

(g) a device for powering the ice scoop system to a home position after an ice shaving operation has been completed; and (h) a device for disposing of the ice shavings collected in the ice scoop system.

2. The apparatus of claim 1 further comprising a device for coupling and uncoupling the ice blade system to the ice scoop system.

3. The apparatus of claim 1 wherein the device for powering the ice blade system and the device for powering the ice scoop system is the same device.

4. The apparatus of claim 1 further comprising a powering device for raising and lowering a portion of a dasher board system that surrounds the ice surface.

5. The apparatus of claim 1 wherein the ice blade system and the ice scoop system are coupled and further associated with a docking bar system.

6. The apparatus of claim 1 wherein the home position of the ice blade system is an end zone apparatus located in a first trench system positioned beyond a first end of, and below a top horizontal level of, the ice surface.

7. The apparatus of claim 1 wherein the home position of the ice scoop system is an end zone apparatus located in a second trench system positioned beyond a second end of, and below a top horizontal level of, the ice surface.

8. The apparatus of claim 1 wherein the home position of the ice blade system and the home position of the ice scoop system is the same end zone apparatus and wherein a docking bar system comprises a part of said apparatus and wherein said docking bar system has a home position in another end zone apparatus that is located opposite to the end zone apparatus that serves as the home position for the ice blade system and the ice scoop system.

9. The apparatus of claim 1 wherein the home position of the ice blade system is a structure located beyond a first end zone of the ice surface and whose bottom level is at an elevation such that an ice blade system that rests upon said bottom level is substantially at an elevation comparable to an elevation of the ice surface and wherein a first end zone dasher board portion is lifted off the ice surface by an array of powered cables.

10. The apparatus of claim 1 wherein the home position of the ice scoop system is a structure located beyond a second end zone of the ice surface and whose bottom level is at an elevation such that an ice scoop system that rests upon said bottom level is substantially at an elevation comparable to an elevation of the ice surface and wherein a second end zone dasher board portion is lifted off the ice surface by an array of powered cables.

11. The apparatus of claim 1 wherein the device for disposing of the ice shavings collected in the ice scoop system is an ice disposal device selected from the group of ice disposal devices consisting of a dump system, a conveyor belt system, a heater system, a hot water system, a cold water system, an auger system, a paddle system or a brush system.

12. The apparatus of claim 1 wherein the device for dispensing water over the ice surface is a water dispensing device selected from the group of water dispensing devices consisting of a misting nozzle system, a spraying nozzle system, a squeegee system or a water saturated absorbent material system.

13. The apparatus of claim 1 wherein the device for dispensing water over the ice surface is capable of delivering variable amounts of water per unit of surface area of the ice surface.

14. The apparatus of claim 1 wherein the ice blade system and the ice scoop system are coupled and the ice blade system is positioned behind the ice scoop system as the ice scoop system is powered in the ice shaving direction.

15. The apparatus of claim 1 wherein the ice blade system extends beyond a kick board that forms a part of a dasher board system of an ice hockey rink.

16. The apparatus of claim 1 wherein the ice blade system has a unitary static blade.

17. The apparatus of claim 1 wherein the ice blade system can be dynamically adjusted vertically using an ice blade depth adjusting device selected from the group of ice blade depth adjusting devices consisting of a servo system, a stepper system or a manually adjusted cap screw system.

18. The apparatus of claim 1 wherein the ice blade system comprises multiple ice shaving blades whose respective ice shaving depth can be individually and dynamically adjusted.

19. The apparatus of claim 1 wherein the ice blade system is a rotating ice shaving blade device.

20. The apparatus of claim 1 wherein the ice blade system is a horizontally oscillating ice shaving blade device.

21. The apparatus of claim 1 wherein the ice blade system is further provided with an ice edging system.

22. The apparatus of claim 1 wherein the ice blade system is further provided with an ice edging system that is employed when a kick plate system is raised.

23. The apparatus of claim 1 wherein the ice blade system has two ice shaving blades that face in opposite directions.

24. The apparatus of claim 1 wherein the ice blade system has a curved configuration.

25. The apparatus of claim 1 wherein the ice blade system and the ice scoop system are coupled and powered in an ice shaving direction by a tension delivering device selected from the group of tension delivering devices selected from the group consisting of: (1) a powered, tension creating chain system attached to the ice scoop system, (2) a powered, tension creating cable system attached to the ice scoop system, (3) a powered, tensioning creating belt system attached to the ice scoop system.

26. The apparatus of claim 1 wherein the powering of the ice blade system to a home position is by a powering device selected from the group of powering devices consisting of: (1) a powered, dynamic chain system, (2) a powered, dynamic cable system, (3) a powered, dynamic belt system, (4) a powered sprocket attached to the ice blade system and driven across a static chain system, (5) one or more powered rack and pinion systems, (6) a powered studded tire system.

27. The apparatus of claim 1 wherein the powering of the ice scoop system to a home position is by a powering device selected from the group of powering devices consisting of: (1) a powered, dynamic chain system, (2) a powered, dynamic cable system, (3) a powered, dynamic belt system, (4) a powered sprocket attached to the ice scoop system and driven across a static chain system, (5) one or more powered rack and pinion systems, and (6) a powered, studded tire system.

28. The apparatus of claim 1 wherein the ice blade system and the ice scoop system are coupled and attached to a docking bar system that is powered by a powering device selected from the group of powering devices consisting of: (1) a powered, tension creating chain system that is attached to the docking bar system, (2) a powered, tension creating cable system that is attached to the docking bar system, (3) a powered, tension creating belt system that is attached to the docking bar system, (4) one or more powered, rack and pinion systems and (5) a powered, studded tire system.

29. The apparatus of claim 1 wherein the ice blade system is further provided with a printing system.

30. The apparatus of claim 1 wherein the ice scoop system is further provided with a printing system.

31. The apparatus of claim 1 further comprising a docking bar and wherein said docking bar is provided with a printing system.

32. The apparatus of claim 1 wherein a powered printer system is made a component of said apparatus.

33. The apparatus of claim 1 wherein the ice blade system and ice scoop system are curved.

34. An apparatus for refurbishing an ice hockey playing surface, said apparatus comprising:

(a) an ice blade system capable of shaving a layer of ice substantially across an entire width dimension of the ice hockey playing surface;

(b) an ice scoop system capable of collecting ice shavings created by shaving the layer of ice substantially across the entire width dimension of the ice hockey playing surface;

(c) a device for coupling and uncoupling the ice blade system and the ice scoop system to create and disassemble a coupled ice blade/scoop system;

(d) a device for raising and lowering an arcuate first end dasher board portion and a device for raising and lowering an arcuate second end dasher board portion of a dasher board system that surrounds the ice hockey playing surface;

(e) a device for powering the coupled ice blade/scoop system in an ice scraping direction substantially across the entire width dimension of the ice hockey playing surface;

(f) a device for dispensing water over the ice hockey playing surface after the layer of ice has been shaved;

(g) a device for powering the ice blade system to a home position after the ice shaving operation has been completed;

(h) a device for powering the ice scoop system to a home position after the ice shaving operation has been completed; and (i) a device for disposing of the ice shavings collected in the ice scoop system.

35. An apparatus for refurbishing an ice hockey playing surface, said apparatus comprising:

(a) an ice blade system capable of shaving a layer of ice substantially across an entire width dimension of the ice hockey playing surface;

(b) an ice scoop system capable of collecting ice shavings created by shaving the layer of ice substantially across the entire width dimension of the ice hockey playing surface;

(c) a docking bar system capable of connecting to and pulling the ice scoop system in an ice shaving direction;

(d) a device for coupling and uncoupling the ice blade system and the ice scoop system to create and disassemble a coupled ice blade/scoop system;

(e) a device for raising and lowering an arcuate first end dasher board portion and a device for raising and lowering an arcuate second end dasher board portion of a dasher board system that surrounds the ice hockey playing surface;

(f) a device for powering the coupled ice blade/scoop systems in an ice scraping direction substantially across the entire width dimension of the ice hockey playing surface;

(g) a device for dispensing water over the ice hockey playing surface after the layer of ice has been shaved;

(h) a device for powering the ice blade system to a home position after the ice shaving operation has been completed;

(i) a device for powering the ice scoop system to a home position after the ice shaving operation has been completed;

(j) a device for powering the docking bar system to a home position after the ice shaving operation has been completed; and (k) a device for disposing of the ice shavings collected in the ice scoop system.

36. A method for refurbishing an ice surface, said method comprising:

(a) providing an ice blade system capable of shaving a layer of ice substantially across an entire dimension of the ice surface in a single pass;

(b) providing an ice scoop system capable of collecting ice shavings created by shaving the layer of ice substantially across the entire dimension of the ice surface;

(c) powering the ice blade system substantially across the entire dimension of the ice surface in an ice shaving direction;

(d) powering the ice scoop system substantially across the entire dimension of the ice surface in an ice shaving direction;

(e) dispensing water over substantially the entire ice surface after it has been shaved;

(f) powering the ice blade system to a home position after an ice shaving operation has been completed;

(g) powering the ice scoop system to a home position after an ice shaving operation has been completed; and (h) disposing of the ice shavings collected in the ice scoop system.

37. The method of claim 36 wherein a portion of a dasher board system surrounding the ice surface is raised and lowered at appropriate times in refurbishing the ice surface.

38. The method of claim 36 wherein the method for powering the ice blade system and the method for powering the ice scoop system both employ the same method.

39. The method of claim 36 wherein the ice blade system is associated with the ice scoop system to create a coupled ice blade/scoop system.

40. The method of claim 36 wherein the home position to which the ice blade system is powered is a first end zone apparatus positioned beyond a first end of, and below the top horizontal level of, the ice surface.

41. The method of claim 36 wherein the home position to which the ice blade system is powered is a structure located beyond a first end zone of the ice surface and whose bottom level is at an elevation such that an ice blade system that rests upon said bottom level is substantially at an elevation comparable to an elevation of the ice surface and wherein a first end zone dasher board portion is lifted off the ice surface by an array of powered cables.

42. The method of claim 36 wherein the home position of the ice scoop system is a second end zone apparatus positioned beyond a second end of, and below the top horizontal level of, the ice surface.

43. The method of claim 36 wherein the home position to which the ice scoop system is powered is a structure located beyond a second end zone of the ice surface and whose bottom level is at an elevation such that an ice scoop system that rests upon said bottom level is substantially at an elevation comparable to an elevation of the ice surface and wherein a second end zone dasher board portion is lifted off the ice surface by an array of powered cables.

44. The method of claim 36 wherein the ice blade system and ice scoop system share a common home position.

45. The method of claim 36 wherein the disposing of the ice shavings collected in the ice scoop system is carried out by an ice disposal method selected from the group of ice disposal methods consisting of dumping, heating, auguring, paddling, conveying on a conveyor belt, or chain driving said ice shavings to an ice shavings disposal point.

46. The method of claim 36 wherein the ice surface is shaved to a desired depth whereupon a resulting ice surface is printed upon and thereafter covered by successive layers of print covering ice.

47. The method of claim 36 wherein the dispensing of water over the ice surface after it has been shaved is by a water dispensing method selected from the group of water dispensing methods consisting of misting, spraying, squeegeeing or associating said water with a water absorbent material.

48. The method of claim 36 wherein the device for dispensing water over the ice surface is capable of delivering variable amounts of water per unit of surface area of the ice surface.

49. The method of claim 36 wherein the ice blade system and the ice scoop system are coupled in an arrangement wherein the ice blade system follows the ice scoop system as the coupled blade/scoop system is powered in the ice scraping direction.

50. The method of claim 36 wherein the ice blade system is extended beyond an entire dimension of the ice surface to be refurbished in order to perform an ice edging function.

51. The method of claim 36 wherein a powered docking bar is attached to the ice scoop system.

52. The method of claim 36 wherein the ice blade system is provided with a unitary static blade.

53. The method of claim 36 wherein the ice blade system is provided with an ice blade system whose ice shaving depth can be dynamically adjusted using dynamic adjusting methods selected from the group of dynamic adjusting methods consisting of making servo adjustments, making stepper adjustments or manually adjusting cap screws.

54. The method of claim 36 wherein the ice blade system is provided with two ice blades that face in opposite directions.

55. The method of claim 36 wherein the ice blade system and the ice scoop system are coupled to produce a coupled ice blade/scoop system that is powered in an ice shaving direction by a powering method selected from the group of powering methods consisting of: (1) tensioning a chain system attached to the coupled ice blade/scoop system, (2) tensioning a cable system attached to the coupled ice blade/scoop system, (3) tensioning a belt system attached to the coupled ice blade/scoop system, (4) engaging the coupled ice blade/scoop system with a powered, rack and pinion system, and (5) providing the ice coupled blade/scoop system with a system of powered, studded tires.

56. The method of claim 36 wherein the ice blade system and the ice scoop system are coupled and connected to a docking bar system that is powered by a powering method selected from the group of powering methods consisting of: (1) tensioning a chain system attached to the docking bar system, (2) tensioning a cable system attached to the docking bar system, (3) tensioning a belt system attached to the docking bar system, (4) engaging the docking bar system with a rack and pinion system, and (5) providing the docking bar system with a system of powered, studded tires.

57. The method of claim 36 wherein the powering of the ice blade system to a home position is by a powering method selected from the group of powering methods consisting of: (1) engaging the ice blade system with a powered, dynamic chain system, (2) engaging the ice blade system with a powered, dynamic cable system, (3) engaging the ice blade system with a powered, belt device, (4) providing the ice blade system with a powered sprocket and engaging the powered sprocket with a static chain system; (5) engaging the ice blade system with a powered, rack and pinion system, and (6) providing the ice blade system with powered studded tire system.

58. The method of claim 36 wherein the powering of the ice scoop system to a home position is by a powering method selected from the group of powering methods consisting of: (1) engaging the ice scoop system with a powered, dynamic chain system, (2) powering a sprocket associated with the ice scoop system across a static chain system, (3) engaging the ice scoop system with a powered, dynamic cable system, (4) engaging the ice scoop system with a powered, dynamic belt system, (5) engaging the ice scoop system with a powered, rack and pinion system, and (6) providing the ice scoop system with powered studded tire system.

59. The method of claim 36 wherein the ice blade system is further provided with a printing system.

60. The method of claim 36 wherein the ice scoop system is further provided with a printing system.

61. The method of claim 36 wherein a docking bar is associated with the ice scoop system and wherein said docking bar is further provided with a printing system.

62. The method of claim 36 wherein a separately powered printer is powered across a new ice surface.

63. A method for refurbishing an ice hockey playing surface, said method comprising:

(a) providing an ice blade system capable of shaving a layer of ice substantially across an entire width dimension of the ice hockey playing surface in a single pass;

(b) providing an ice scoop system capable of collecting ice shavings created by shaving the layer of ice substantially across the entire width dimension of the ice hockey playing surface;

(c) associating the ice scoop system with the ice blade system to create a coupled ice blade/scoop system;

(d) raising an arcuate first end dasher board portion and an arcuate second end dasher board portion of a dasher board system that surrounds the ice hockey playing surface;

(e) powering the coupled ice blade/scoop system in an ice shaving direction substantially across the entire width dimension of the ice hockey playing surface;

(f) dispensing water over the ice hockey playing surface after the layer of ice has been shaved;

(g) powering the ice blade system to a home position after the ice shaving operation has been completed;

(h) powering the ice scoop system to a home position after the ice shaving operation has been completed;

(i) lowering the arcuate first end dasher board portion and the arcuate second end dasher board portion; and (j) disposing of the ice shavings collected in the ice scoop system.

64. A method for refurbishing an ice hockey playing surface, said method comprising:

(a) providing an ice blade system capable of shaving a layer of ice substantially across an entire width dimension of the ice hockey playing surface to be refurbished in a single pass;

(b) providing an ice scoop system capable of collecting ice shavings created by shaving the layer of ice substantially across the entire width dimension of the ice hockey playing surface;

(c) associating the ice scoop system with the ice blade system to create a coupled ice blade/scoop system;

(d) associating the coupled ice blade/scoop system with a docking bar system to create an ice blade/scoop/docking bar system;

(e) raising an arcuate first end dasher board portion and an arcuate second end dasher board portion of a dasher board system that surrounds the ice hockey playing surface;

(f) powering the ice blade/scoop/docking bar system in an ice shaving direction substantially across the entire width dimension of the ice hockey playing surface;

(g) dispensing water over the ice hockey playing surface after the layer of ice has been shaved;

(h) powering the ice blade system to a home position after the ice shaving operation has been completed;

(i) powering the ice scoop system to a home position after the ice shaving operation has been completed;

(j) powering the docking bar system to a home position after the ice shaving operation has been completed;

(k) lowering the arcuate first end dasher board portion and the arcuate second end dasher board portion; and (l) disposing of the ice shavings collected in the ice scoop system.

* * * * *